US010681467B2

(12) United States Patent
Lee et al.

(10) Patent No.: US 10,681,467 B2
(45) Date of Patent: Jun. 9, 2020

(54) SLIM ACOUSTIC TRANSDUCER AND IMAGE DISPLAY APPARATUS HAVING THE SAME

(71) Applicant: SAMSUNG ELECTRONICS CO., LTD., Suwon-si, Gyeonggi-do (KR)

(72) Inventors: Gyeong-tae Lee, Seoul (KR); Jong-bae Kim, Seoul (KR); Sung-ha Son, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 408 days.

(21) Appl. No.: 15/402,393

(22) Filed: Jan. 10, 2017

(65) Prior Publication Data

US 2017/0332174 A1 Nov. 16, 2017

Related U.S. Application Data

(60) Provisional application No. 62/334,692, filed on May 11, 2016.

(30) Foreign Application Priority Data

Aug. 17, 2016 (KR) ..... 10-2016-0104070

(51) Int. Cl.

| | |
|---|---|
| ***H04R 9/00*** | (2006.01) |
| ***H04R 9/04*** | (2006.01) |
| ***H04R 9/06*** | (2006.01) |
| ***H04R 9/02*** | (2006.01) |
| *H04R 7/04* | (2006.01) |

(52) U.S. Cl.
CPC ..... *H04R 9/045* (2013.01); *H04R 9/025* (2013.01); *H04R 9/06* (2013.01); *H04R 7/04* (2013.01); *H04R 9/043* (2013.01); *H04R 2499/15* (2013.01)

(58) Field of Classification Search
CPC ..... H04R 7/04; H04R 9/025
See application file for complete search history.

(56) References Cited

U.S. PATENT DOCUMENTS 3,012,107 A * 12/1961 Hanlet ..... H04R 9/025 381/398
8,131,002 B2 * 3/2012 Takewa ..... H04R 11/02 381/399

(Continued)

FOREIGN PATENT DOCUMENTS

| | | |
|---|---|---|
| JP | 3963173 | 8/2007 |
| KR | 10-1587477 | 1/2016 |
| KR | 10-1596891 | 2/2016 |

OTHER PUBLICATIONS

Korean Office Action dated Apr. 14, 2020 for KR Application No. 10-2016-0104070.

*Primary Examiner* — Matthew A Eason
(74) *Attorney, Agent, or Firm* — Nixon & Vanderhye P.C.

(57) ABSTRACT

The present disclosure relates to a slim acoustic transducer having a thin thickness a low-frequency reproduction capability and a sound pressure level in the entire frequency band of which may not be lowered. A slim acoustic transducer includes a diaphragm; a voice coil disposed at a peripheral portion of the diaphragm; and a permanent magnet disposed around the voice coil and configured to apply a magnetic field to the voice coil, wherein a maximum amplitude of the diaphragm is less than a thickness of the permanent magnet.

20 Claims, 25 Drawing Sheets

(56) References Cited

U.S. PATENT DOCUMENTS

| | | | | |
|---|---|---|---|---|
| 8,351,631 | B2 | 1/2013 | Lee et al. | |
| 8,411,882 | B2 | 4/2013 | Lee et al. | |
| 9,071,898 | B2 | 6/2015 | Cazes Bouchet | |
| 2005/0163338 | A1* | 7/2005 | Ohashi ..... | H04R 9/025<br>381/421 |

* cited by examiner

SLIM ACOUSTIC TRANSDUCER AND IMAGE DISPLAY APPARATUS HAVING THE SAME

CROSS-REFERENCE TO RELATED APPLICATIONS

This application is based on and claims priority under 35 U.S.C. § 119 to U.S. provisional application No. 62/334,692, filed May 11, 2016, in the United States Patent & Trademark Office, and Korean Patent Application No. 10-2016-0104070 filed Aug. 17, 2016 in the Korean Intellectual Property Office, the disclosures of which are incorporated by reference herein in their entireties.

BACKGROUND

1. Field

The present disclosure relates generally to an acoustic transducer capable of reproducing sound. For example, the present disclosure relates to a slim acoustic transducer that can be used in thin electronic devices and an image display apparatus having the same.

2. Description of Related Art

With the development of electronic technology, a thickness of the TV becomes thinner, and now a slim TV, a thickness of which is thin, is becoming popular. In addition, a mobile device, such as a smartphone, a tablet computer, a notebook computer, etc., is required to be reduced in thickness for convenience of carrying.

In order to reduce the thickness of a TV or a mobile device, it is necessary to reduce the thickness of an acoustic transducer such as a speaker for outputting sound as well as the thickness of a display portion such as a liquid crystal display for outputting videos.

A slim acoustic transducer as illustrated in FIG. 1 has been developed and used to reduce the thickness of the TV or the mobile device.

Referring to FIG. 1, in the conventional slim acoustic transducer 1, a permanent magnet 5 is disposed below a diaphragm 3 and a yoke 7 is provided around the permanent magnet 5. A voice coil 9 disposed below the diaphragm 3 is positioned between the permanent magnet 5 and the yoke 7 so that a magnetic field of the permanent magnet 5 is applied to the voice coil 9. The voice coil 9, the permanent magnet 5, and the yoke 7 constitute an electric motor system for driving the diaphragm 3. Accordingly, the diaphragm 3 vibrates based on the change of the current flowing through the voice coil 9, thereby reproducing sound.

The conventional slim acoustic transducer 1 has a structure in which the electric motor system for driving the diaphragm 3, in particular, the permanent magnet 5 is provided below the diaphragm 3 so that the electric motor system and the diaphragm 3 are overlapped. Accordingly, in order to reduce the thickness T of the acoustic transducer 1, it is necessary to reduce the thickness of the electric motor system or to reduce an operating range of the diaphragm 3, that is, an amplitude of the diaphragm 3.

However, when the thickness of the electric motor system is made thin, the magnetic flux density of the permanent magnet is reduced so that the magnetic force is decreased. As a result, there is a problem that the sound pressure level is greatly lowered in the entire frequency band. Further, when the operating range of the diaphragm is reduced, there is a problem that the low-frequency reproduction capability is largely lowered.

Accordingly, development of a slim acoustic transducer that addresses the above-described problems and can reduce the thickness thereof has been required.

SUMMARY

The present disclosure has been developed to address the above drawbacks and other problems associated with the conventional arrangement. An example aspect of the present disclosure relates to a slim acoustic transducer having a thin thickness a low-frequency reproduction capability and a sound pressure level in substantially the entire frequency band of which may not be lowered.

According to an example aspect of the present disclosure, a slim acoustic transducer may include a diaphragm; a voice coil disposed at a rim (e.g., peripheral portion) of the diaphragm; and a permanent magnet disposed around the voice coil and configured to apply a magnetic field to the voice coil, wherein a maximum amplitude of the diaphragm is less than a thickness of the permanent magnet.

The permanent magnet may include an intermediate plate provided around the voice coil; an upper permanent magnet provided on a top surface of the intermediate plate; and a lower permanent magnet provided on a bottom surface of the intermediate plate.

The upper permanent magnet and the lower permanent magnet may be provided on the intermediate plate so that equal magnetic poles face each other.

Each of the upper permanent magnet and the lower permanent magnet may be provided with a plurality of air passages disposed in a radial direction. Each of the upper permanent magnet and the lower permanent magnet may be comprised of a plurality of permanent magnet pieces, and the plurality of air passages may be provided between the plurality of permanent magnet pieces.

The slim acoustic transducer may include a frame configured to support and fix the intermediate plate, the upper permanent magnet, and the lower permanent magnet.

The slim acoustic transducer may include a surround connecting a top surface of the diaphragm and a top surface of the intermediate plate; and a suspension connecting a bottom surface of the diaphragm and a bottom surface of the intermediate plate.

The slim acoustic transducer may include an enclosure provided to be in contact with a top surface of the upper permanent magnet and a bottom surface of the lower permanent magnet.

A magnetic body may not be provided below the diaphragm.

According to another example aspect of the present disclosure, a slim acoustic transducer may include a diaphragm; a voice coil disposed at a rim (e.g., peripheral portion) of the diaphragm; and a permanent magnet disposed around the voice coil and configured to apply a magnetic field to the voice coil, wherein the permanent magnet may include an intermediate plate provided around the voice coil; an upper permanent magnet disposed on a top surface of the intermediate plate; and a lower permanent magnet disposed on a bottom surface of the intermediate plate.

When the diaphragm moves maximally upward, the diaphragm may not protrude above a top surface of the upper permanent magnet, and when the diaphragm moves maximally downward, the diaphragm may not protrude below a bottom surface of the lower permanent magnet.

According to another example aspect of the present disclosure, an image display apparatus may include a flat display panel configured to output video; and a slim acoustic transducer provided at a side of the flat display panel and configured to output sound, wherein the slim acoustic transducer may include any one of the above-described features.

Other objects, advantages and salient features of the present disclosure will become apparent from the following detailed description, which, taken in conjunction with the annexed drawings, discloses various example embodiments.

BRIEF DESCRIPTION OF THE DRAWINGS

These and/or other aspects, features and advantages of the present disclosure will become apparent and more readily appreciated from the following detailed description, taken in conjunction with the accompanying drawings, in which like reference numerals refer to like elements, and wherein.

Throughout the drawings, like reference numerals will be understood to refer to like parts, components and structures.

DETAILED DESCRIPTION

Hereinafter, various example embodiments of the present disclosure will be described in greater detail with reference to the accompanying drawings.

The matters disclosed herein, such as a detailed construction and elements thereof, are provided to aid in a comprehensive understanding of this disclosure. Thus, it is apparent that various example embodiments may be carried out without those defined matters. Also, well-known functions or constructions may be omitted to provide a clear and concise description of various example embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are used to simply distinguish one component from the others.

The terms used in the present application are only used to describe the various example embodiments, but are not intended to limit the scope of the disclosure. The singular expression also includes the plural meaning as long as it does not conflict with the meaning in context. In the present application, the terms "include" and "consist of" designate the presence of features, numbers, steps, operations, components, elements, or a combination thereof that are written in the disclosure, but do not exclude the presence or possibility of addition of one or more other features, numbers, steps, operations, components, elements, or a combination thereof.

Figure 1:
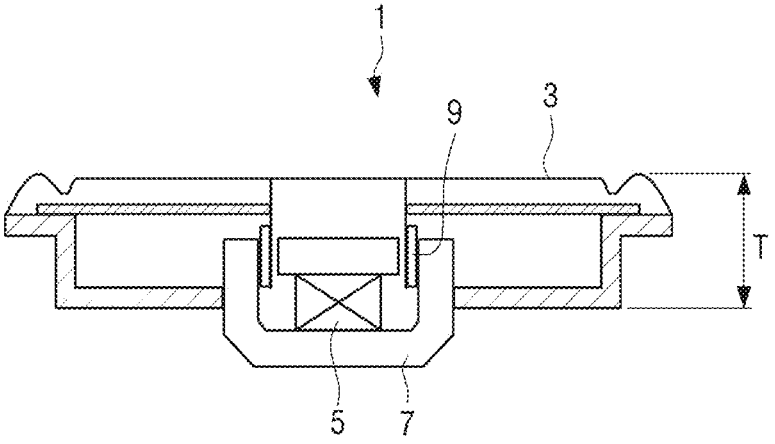
FIG. 1 (PRIOR ART)
FIG. 1 is a cross-sectional diagram illustrating a conventional acoustic transducer.
Figure 2:
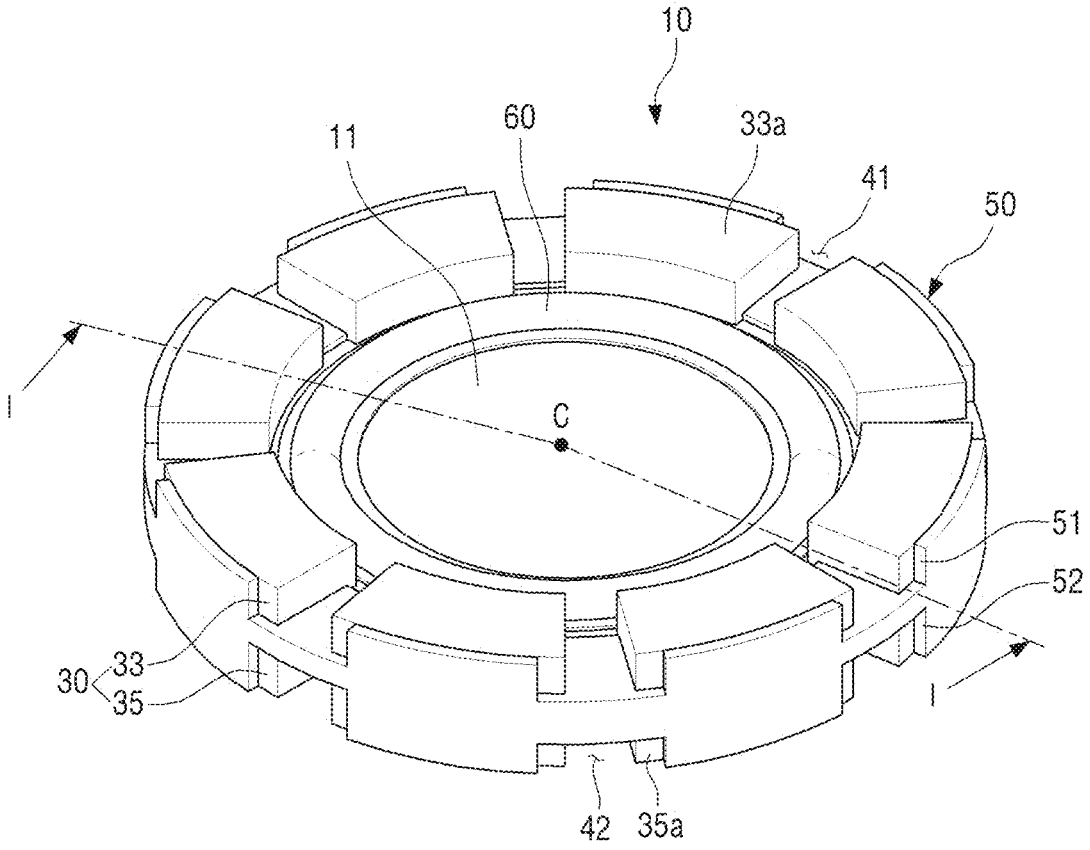
FIG. 2 is a perspective view illustrating an example slim acoustic transducer according to an example embodiment of the present disclosure.
Figure 3:
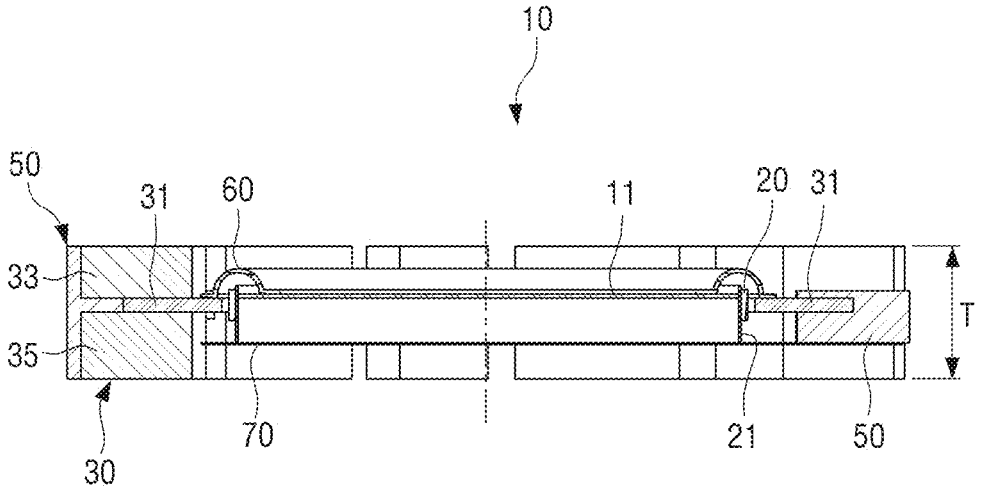
FIG. 3 is a cross-sectional view illustrating the slim acoustic transducer of FIG. 2 taken along a line of I-I.
Figure 4:
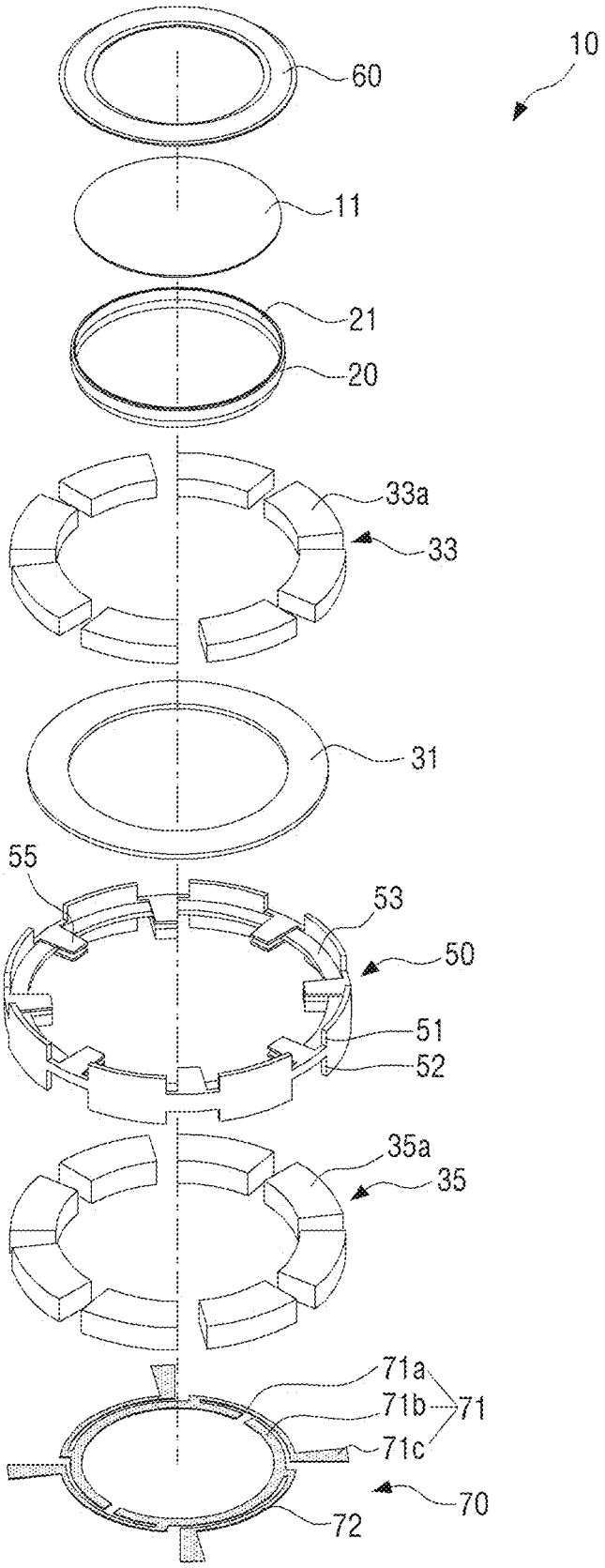
FIG. 4 is an exploded perspective view illustrating the slim acoustic transducer of FIG. 2.
Figure 5:
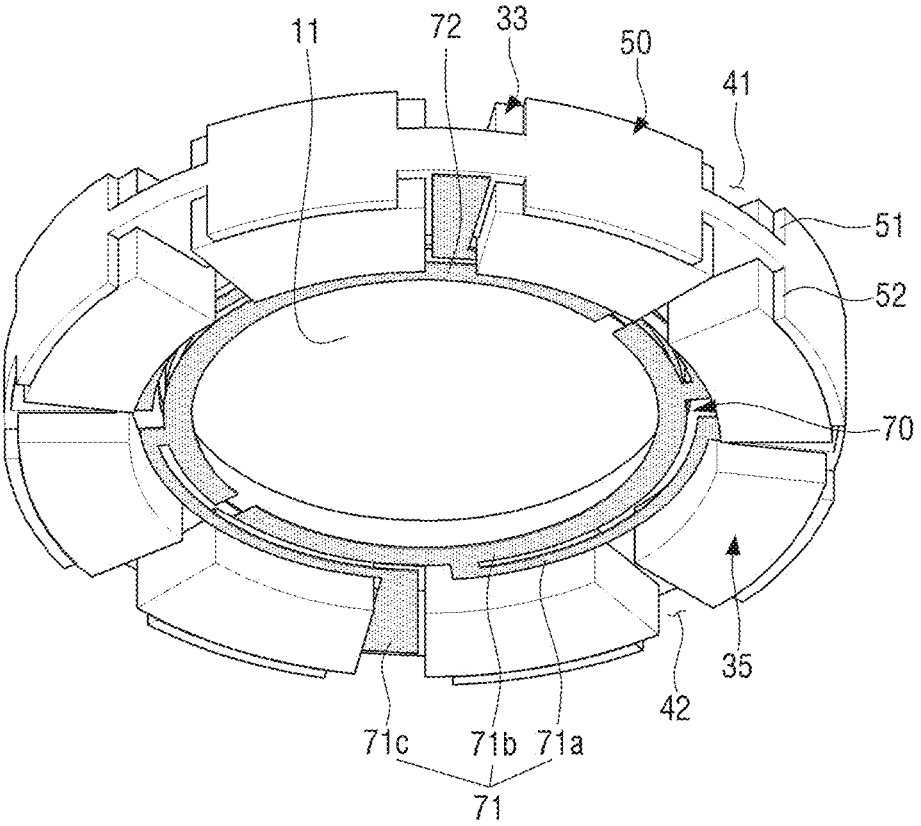
FIG. 5 is a rear perspective view illustrating the slim acoustic transducer of FIG. 2.

FIG. 2 is a perspective view illustrating an example slim acoustic transducer according to an example embodiment of the present disclosure. FIG. 3 is a cross-sectional view illustrating the slim acoustic transducer of FIG. 2 taken along a line of I-I. FIG. 4 is an exploded perspective view illustrating the slim acoustic transducer of FIG. 2, and FIG. 5 is a rear perspective view illustrating the slim acoustic transducer of FIG. 2.

Referring to FIGS. 2 to 5, a slim acoustic transducer 10 according to an example embodiment of the present disclosure may include a diaphragm 11, a voice coil 20, and a permanent magnet 30.

The diaphragm 11 vibrates depending on the movement of the voice coil 20 to produce a compressional wave of air particles, thereby producing sound. The diaphragm 11 is formed in a thin plate shape. The diaphragm 11 may, for example, comprise cotton-fabric, compression-molded sponge, rubber, synthetic resin, metal, and the like. Depending on weight and area of the diaphragm 11, a lower limit frequency may vary.

The voice coil 20 is provided on the rim of the diaphragm 11. At this time, only the voice coil 20 may be vertically provided on the rim of the diaphragm 11. As another example, the voice coil 20 may be formed by providing a hollow bobbin 21 on the rim of the diaphragm 11 and winding wire on the outer circumferential surface of the hollow bobbin 21. Accordingly, when the voice coil 20 vibrates, the diaphragm 11 is vibrated to reproduce sound. It will be understood that the terms rim and peripheral portion may be used interchangeably.

The permanent magnet 30 is disposed around the voice coil 20 to surround the diaphragm 11 and the voice coil 20. The permanent magnet 30 is configured to apply a magnetic field to the voice coil 20 so that the voice coil 20 can vibrate based on the change of the current flowing through the voice coil 20.

As illustrated in FIGS. 3 and 4, the permanent magnet 30 may include an intermediate plate 31, an upper permanent magnet 33, and a lower permanent magnet 35.

The intermediate plate 31 is disposed around the voice coil 20. For example, the intermediate plate 31 may be formed in a thin donut shape, and the diaphragm 11 and the voice coil 20 are provided in the center of the intermediate plate 31. The intermediate plate 31 may be formed of a magnetic material. For example, the intermediate plate 31 may be made of a steel plate cold commercial (SPCC).

The upper permanent magnet 33 is disposed on the top surface of the intermediate plate 31, and the lower permanent magnet 35 is disposed on the bottom surface of the intermediate plate 31. Accordingly, the intermediate plate 31 is disposed to be sandwiched between the upper permanent magnet 33 and the lower permanent magnet 35. In other words, the lower permanent magnet 35, the intermediate plate 31, and the upper permanent magnet 33 are stacked in this order. The thickness of the upper permanent magnet 33 and the lower permanent magnet 35 may be determined to be larger than the maximum displacement of the diaphragm 11. For example, when the diaphragm 11 vibrates, the thickness of each of the upper permanent magnet 33 and the lower permanent magnet 35 may be configured so that the diaphragm 11 does not protrude above the upper permanent magnet 33 or below the lower permanent magnet 35.

Figure 6:
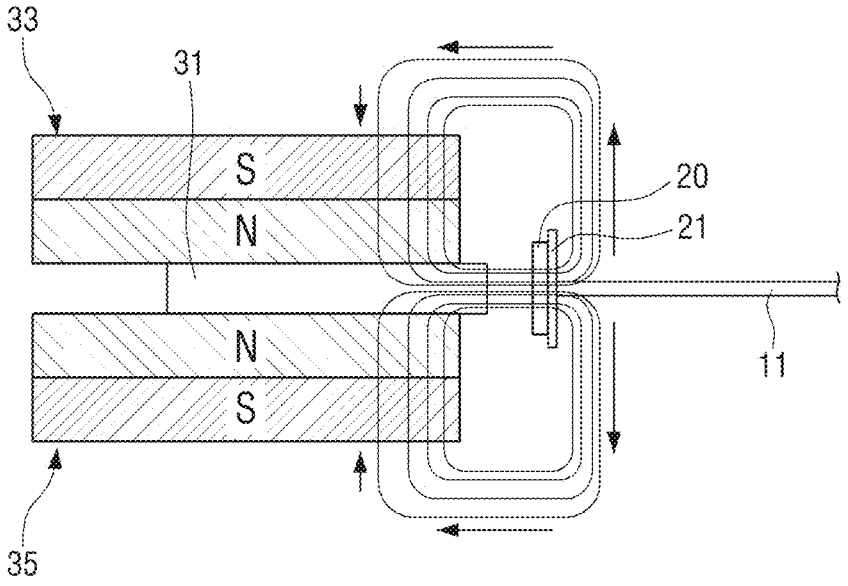
FIG. 6 is a diagram illustrating a magnetic flux flow of an electric motor system of a slim acoustic transducer according to an example embodiment of the present disclosure.

As illustrated in FIG. 6, the upper permanent magnet 33 and the lower permanent magnet 35 are disposed on the intermediate plate 31 so that the same magnetic poles face each other. When the intermediate plate 31 is interposed between the upper permanent magnet 33 and the lower permanent magnet 35 the same magnetic poles of which face each other, a large magnetic flux may be obtained by minimizing and/or reducing the leakage magnetic flux by a repulsive magnetic field.

FIG. 6 is a diagram illustrating an example magnetic flux flow of an electric motor system of a slim acoustic transducer according to an example embodiment of the present disclosure. For example, the electric motor system is configured to operate the diaphragm 11, and includes the voice coil 20, the upper permanent magnet 33, the lower permanent magnet 35, and the intermediate plate 31.

Referring to FIG. 6, the N-pole of the upper permanent magnet 33 is provided to be in contact with the top surface of the intermediate plate 31, and the N-pole of the lower permanent magnet 35 is provided to be in contact with the bottom surface of the intermediate plate 31. Accordingly, the magnetic flux of each of the upper permanent magnet 33 and the lower permanent magnet 35 is concentrated on the voice coil 20 through the intermediate plate 31. Accordingly, a large magnetic flux may be applied to the voice coil 20 by minimizing and/or reducing the leakage magnetic flux without providing a magnet or a magnetic body below the diaphragm 11.

The inventors performed magnetic field analysis to confirm whether that the electric motor system of the slim acoustic transducer 10 according to an example embodiment of the present disclosure having the above-described configuration forms a closed magnetic flux path and the magnetic flux is concentrated in the voice coil 20.

Figure 7:
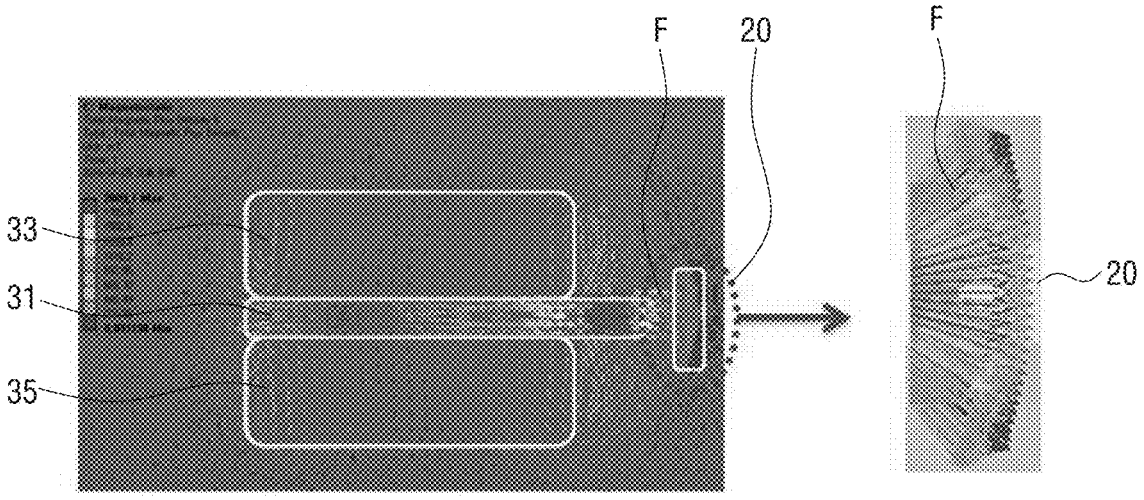
FIG. 7 is an image illustrating a result of computer simulation analysis of an electric motor system of a slim acoustic transducer according to an example embodiment of the present disclosure.

Physical properties of NdFeB-48H is applied to the upper permanent magnet 33 and the lower permanent magnet 35, SPCC is applied to the intermediate plate 31, and then computer simulation analysis is performed. FIG. 7 is an image illustrating a result of computer simulation analysis of an electric motor system of a slim acoustic transducer 10 according to an example embodiment of the present disclosure.

Referring to FIG. 7, it can be seen that the closed magnetic flux path of the electric motor system of the slim acoustic transducer 10 is formed to spread upward and downward from the intermediate plate 31, and the magnetic flux F is concentrated to the voice coil 20 as much as possible by the repulsive magnetic field. Accordingly, it can be seen that when the electric motor system is configured by applying the repulsive magnetic field, the magnetic force loss due to the leakage magnetic flux may be minimized and/or substantially reduced.

In FIG. 6, the upper permanent magnet 33 and the lower permanent magnet 35 are provided on the intermediate plate 31 so that the N-poles face each other, but they may be provided in the opposite manner. Although not illustrated, the upper permanent magnet 33 and the lower permanent magnet 35 may be provided on the intermediate plate 31 so that the S-poles face each other.

The upper permanent magnet 33 may be formed of a plurality of permanent magnet pieces 33*a*. For example, the upper permanent magnet 33, as illustrated in FIGS. 2 and 4, may be formed of the plurality of permanent magnet pieces 33*a* having a shape in which a donut-shaped permanent magnet is cut into several pieces. Accordingly, the upper permanent magnet 33 may be formed by arranging the plurality of permanent magnet pieces 33*a* in a substantially circular shape at substantially regular intervals on the top surface of the intermediate plate 31. A gap between two adjacent permanent magnet pieces 33*a* forms an air passage 41 through which air passes. Accordingly, the upper permanent magnet 33 includes a plurality of air passages 41 provided between the plurality of permanent magnet pieces 33*a*. The plurality of air passages 41 are formed in a radial direction from the center of the upper permanent magnet 33, for example, the center C of the diaphragm 11. The plurality of air passages 41 as described above are paths through which the air moves when the diaphragm 11 vibrates.

As illustrated in FIGS. 2 and 4, the upper permanent magnet 33 includes eight permanent magnet pieces 33*a* and eight air passages 41. However, the number of the permanent magnet pieces 33*a* and the number of the air passages 41 are not limited thereto. Depending on the characteristics of the acoustic transducer 10 in need, the number of each of the permanent magnet pieces 33*a* and the air passages 41 of the upper permanent magnet 33 may be variously determined.

The lower permanent magnet 35 also may be formed of a plurality of permanent magnet pieces 35*a*. For example, the lower permanent magnet 35, as illustrated in FIGS. 4 and 5, may be formed of a plurality of permanent magnet pieces 35*a* having a shape in which a donut-shaped permanent magnet is cut into several pieces. Accordingly, the lower permanent magnet 35 may be formed by arranging the plurality of permanent magnet pieces 35*a* in a substantially circular shape at substantially regular intervals on the bottom surface of the intermediate plate 31. A gap between two adjacent permanent magnet pieces 35*a* forms an air passage 42 through which air passes. Accordingly, the lower permanent magnet 35 includes a plurality of air passages 42 provided between the plurality of permanent magnet pieces 35*a*. The plurality of air passages 42 are formed in a radial direction from the center of the lower permanent magnet 35, for example, the center C of the diaphragm 11. The plurality of air passages 42 as described above are paths through which the air moves when the diaphragm 11 vibrates.

In FIGS. 4 and 5, the lower permanent magnet 35 includes eight permanent magnet pieces 35*a* and eight air passages 42. However, the number of the permanent magnet pieces 35*a* and the number of the air passages 42 are not limited thereto. Depending on the characteristics of the acoustic transducer 10 in need, the number of each of the permanent magnet pieces 35*a* and the air passages 42 of the lower permanent magnet 35 may be variously determined. Also, the number of the plurality of permanent magnet pieces 35*a* and the air passages 42 constituting the lower permanent magnet 35 may be determined differently from the number of the plurality of permanent magnet pieces 33*a* and the plurality of air passages 41 constituting the upper permanent magnet 33.

Further, referring to FIGS. 2 and 5, the plurality of air passages 41 of the upper permanent magnet 33 and the plurality of air passages 41 of the lower permanent magnet 35 are provided to coincide with each other in the vertical direction, but this is only an example. Although not illustrated, the plurality of air passages 41 of the upper permanent magnet 33 and the plurality of air passages 41 of the lower permanent magnet 35 are provided to be offset from each other in the vertical direction.

The intermediate plate 31 may be fixed to a frame 50 and supports the diaphragm 11. For this purpose, the top surface of the diaphragm 11 and the top surface of the intermediate plate 31 are connected by a surround 60. For example, the rim or peripheral portion of the top surface of the diaphragm 11 and the inner rim or peripheral portion of the top surface of the intermediate plate 31 are connected by the surround 60 so that the diaphragm 11 is fixed to the intermediate plate 31. At this time, the surround 60 is provided all around the rim of the top surface of the diaphragm 11. The surround 60 is formed of an elastic material such as rubber so that the diaphragm 11 can vibrate up and down integrally with the voice coil 20. The surround structure described above and hereinafter may also be referred to as a surround structure.

Further, the bottom surface of the diaphragm 11 and the bottom surface of the intermediate plate 31 are connected by a suspension structure 70. For example, the rim of the bottom surface of the diaphragm 11 and the inner rim of the bottom surface of the intermediate plate 31 are connected by the suspension structure 70 (hereinafter referred to as a suspension). The suspension 70 may, for example, be formed of a thin metal plate, and is provided to transmit current to the voice coil 20. In other words, the suspension 70 is formed to perform a function of a lead wire that transmits current to the voice coil 20 together with a function of supporting the diaphragm 11.

For this purpose, as illustrated in FIG. 4, the suspension 70 may be comprised of two separate suspensions, for example, a first suspension 71 and a second suspension 72, which can support the rim of the bottom surface of the diaphragm 11. The first suspension 71 and the second suspension 72 may be configured to support half of the rim of the bottom surface of the diaphragm 11, respectively.

For example, the first suspension 71 may include a fixing portion 71*a* fixed to the intermediate plate 31 and a supporting portion 71*b* fixed to the diaphragm 11. The supporting portion 71*b* is formed in a shape corresponding to the rim of the diaphragm 11, the fixing portion 71*a* is bent along the supporting portion 71*b*, and a distal end 71*c* of the fixing portion 71*a* is bent in the radial direction. Two fixing portions 71*a* are provided, and the distal end 71*c* of the fixing portion 71*a* may be formed to be inserted into the air passage 42 of the lower permanent magnet 35. The second suspension 72 may be formed in the same manner as the first suspension 71, and thus a detailed description thereof is omitted. Although FIG. 4 illustrates and describes the case in which two fixing portions 71*a* are formed, the number of the fixing portions 71*a* is not limited thereto. The fixing portion 71*a* may be provided in three or more as necessary.

An end of the voice coil 20 is connected to the first suspension 71, and the other end of the voice coil 20 is connected to the second suspension 72. Accordingly, the voice coil 20 may be connected to an electric circuit (not illustrated) that outputs current corresponding to a voice signal through the suspension 70.

The intermediate plate 31, the upper permanent magnet 33, and the lower permanent magnet 35 as described above may be fixed to and supported by the frame 50. For example, the frame 50 may be formed in a shape corresponding to the upper permanent magnet 33 and the lower permanent magnet 35. In the present example embodiment, since each of the upper permanent magnet 33 and the lower permanent magnet 35 is formed in a substantially circular shape, the frame 50 is also formed in a substantially circular shape. The frame 50 may be provided with a plurality of openings 51 and 52 corresponding to the plurality of air passages 41 and 42 of each of the upper permanent magnet 33 and the lower permanent magnet 35. Accordingly, spaces above and below the diaphragm 11 and the outside of the slim acoustic transducer 10 are in fluid communication with each other through the plurality of openings 51 and 52 of the frame 50 and the plurality of air passages 41 and 42 of the permanent magnet 30.

A plurality of seating portions 53 may be formed on the inner circumferential surface of the frame 50. The plurality of seating portions 53 are formed to protrude toward the center from the inner surface of the frame 50. The plurality of permanent magnet pieces 33*a* comprising the upper permanent magnet 33 are placed on the top surfaces of the plurality of seating portions 53, and the plurality of permanent magnet pieces 35*a* constituting the lower permanent magnet 35 are placed on the bottom surfaces of the plurality of seating portions 53. The thickness of the plurality of seating portions 53 may be formed in the same as the thickness of the intermediate plate 31. A plurality of fixing protrusions 55 for fixing the intermediate plate 31 are provided between the plurality of seating portions 53.

As described above, in the slim acoustic transducer 10 according to an example embodiment of the present disclosure, since the permanent magnet 30 is provided around the diaphragm 11, the size of the permanent magnet 30 is not limited by the diaphragm 11. For example, when the thickness T of the slim acoustic transducer 10 is limited, the permanent magnet 30 may be made larger in diameter to increase the magnetic force.

Figure 8:
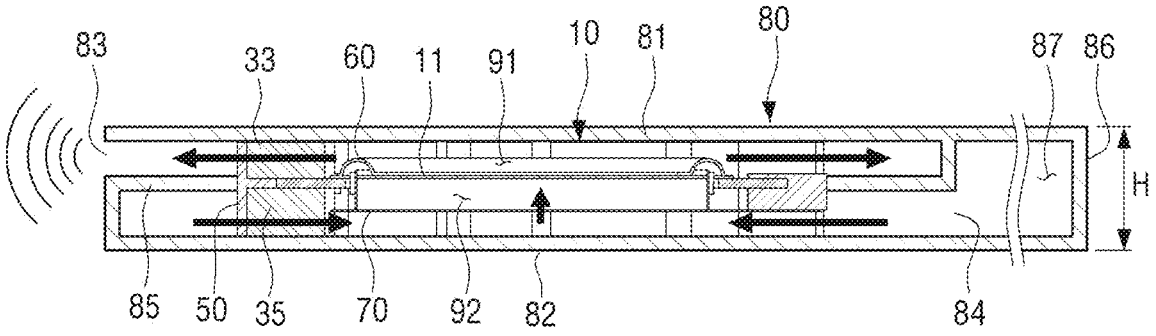
FIG. 8 is a cross-sectional view illustrating an example slim acoustic transducer according to an example embodiment of the present disclosure disposed in an enclosure.
Figure 9:
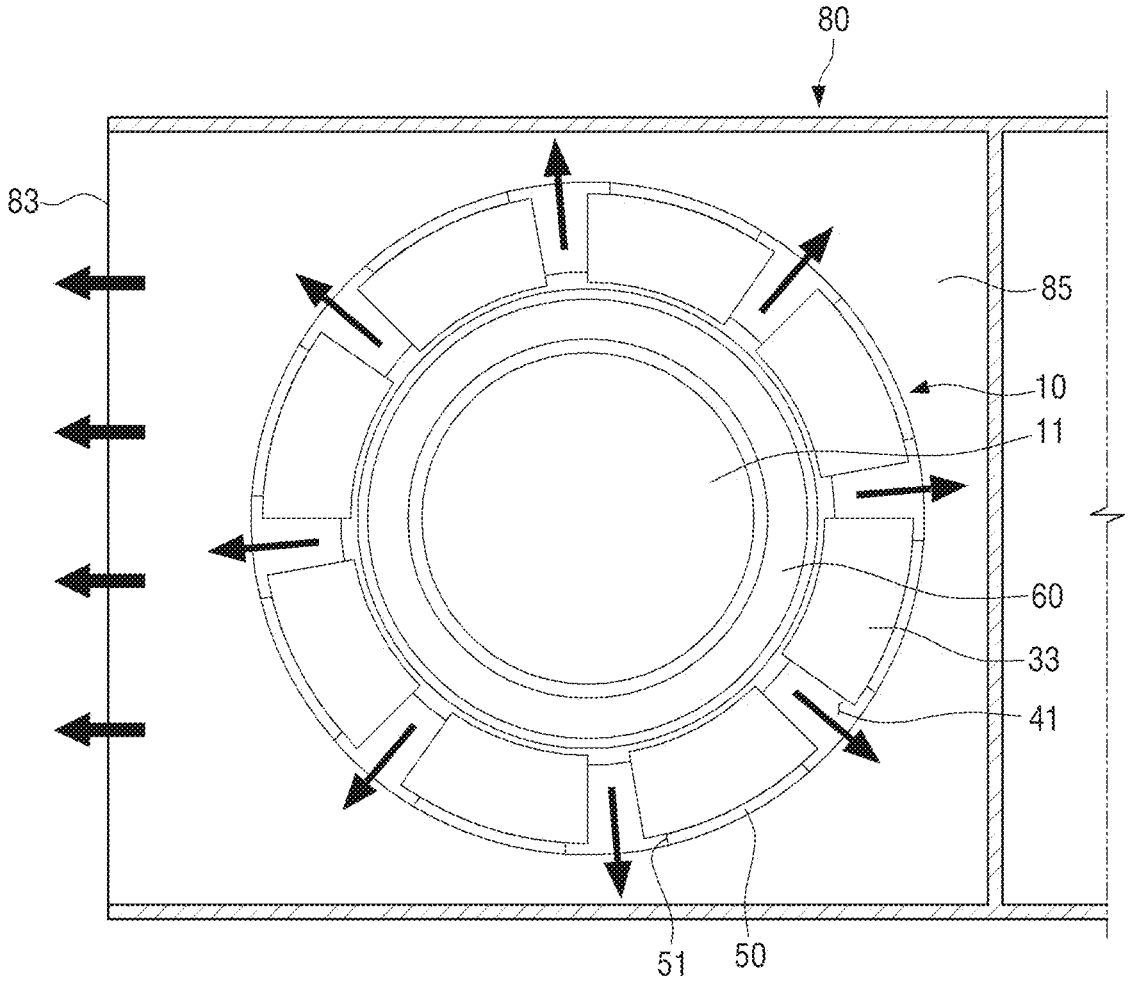
FIG. 9 is a plan view illustrating an example slim acoustic transducer according to an example embodiment of the present disclosure disposed in an enclosure.
Figure 10:
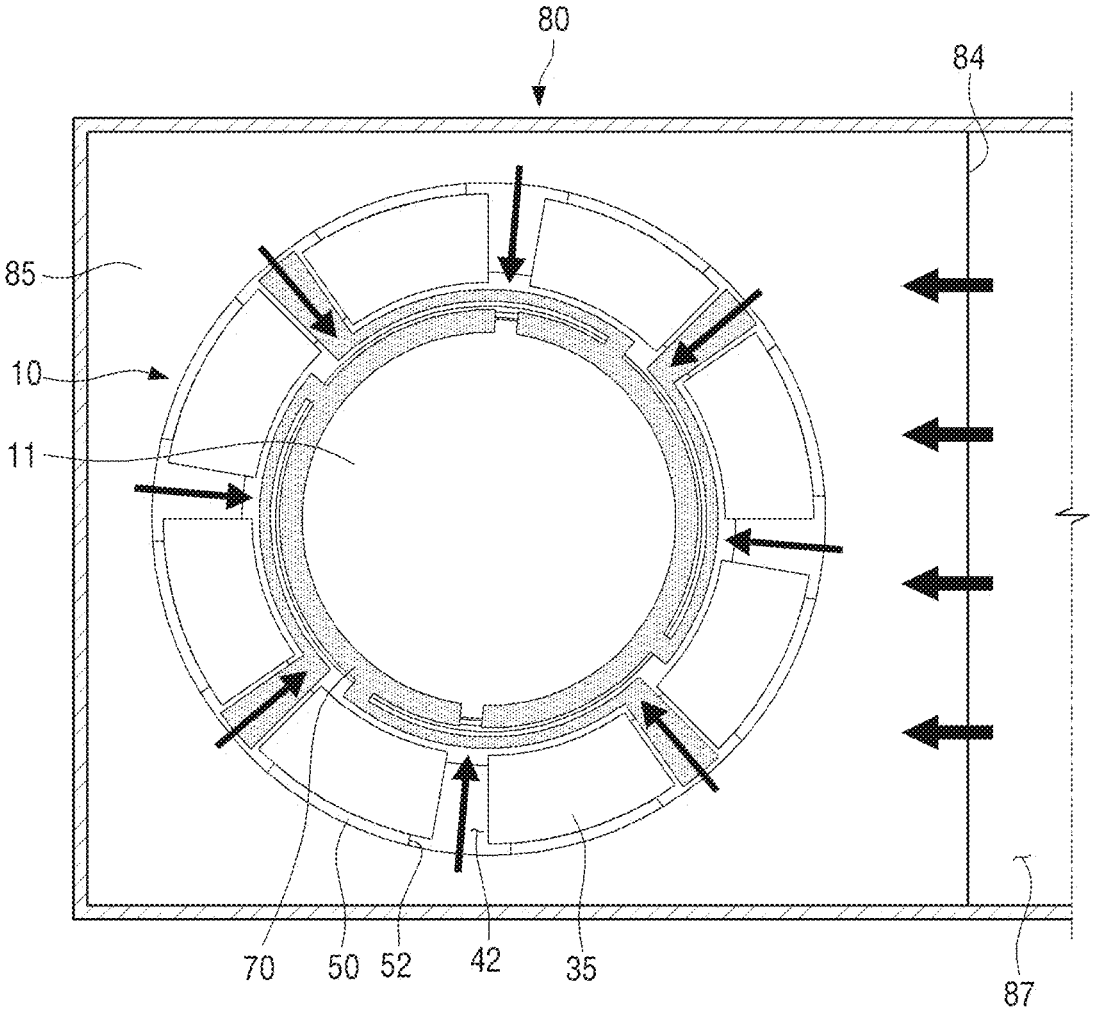
FIG. 10 is a rear view illustrating an example slim acoustic transducer according to an example embodiment of the present disclosure disposed in an enclosure.

The slim acoustic transducer 10 according to the present example embodiment may be received in an enclosure 80 (illustrated, for example, in FIGS. 8 to 10). The enclosure 80 may be formed in such a shape that the upper side of the diaphragm 11 is opened and the lower side of the diaphragm 11 is enclosed. In order to reduce the height (or thickness) H of the enclosure 80, the top and bottom surfaces of the slim acoustic transducer 10 may be formed to be in contact with upper and lower walls 81 and 82 of the enclosure 80, respectively.

Hereinafter, an enclosure in which a slim acoustic transducer according to an example embodiment of the present disclosure is disposed will be described with reference to FIGS. 8 to 10.

FIG. 8 is a cross-sectional view illustrating an example slim acoustic transducer according to an example embodiment of the present disclosure disposed in an enclosure. FIG. 9 is a plan view illustrating an example slim acoustic transducer according to an example embodiment of the present disclosure disposed in an enclosure, and FIG. 10 is a rear view illustrating an example slim acoustic transducer according to an example embodiment of the present disclosure disposed in an enclosure. For reference, FIG. 9 illustrates a state in which an upper wall 81 of the enclosure 80 covering the upper permanent magnet 33 is removed, and FIG. 10 illustrates a state in which a lower wall 82 of the enclosure 80 covering the lower permanent magnet 35 is removed.

Referring to FIG. 8, the top and bottom surfaces of the slim acoustic transducer 10 according to an example embodiment of the present disclosure are covered by the upper wall 81 and the lower wall 82 of the enclosure 80, respectively. For example, the top surface of the upper permanent magnet 33 of the slim acoustic transducer 10 is in contact with the upper wall 81 of the enclosure 80, and the bottom surface of the lower permanent magnet 35 is in contact with the lower wall 82 of the enclosure 80.

Accordingly, the upper side of the diaphragm 11 of the slim acoustic transducer 10 is covered by the upper wall 81 of the enclosure 80 so that an upper space 91 of the diaphragm 11 is formed between the top surface of the diaphragm 11 surrounded by the upper permanent magnet 33 and the upper wall 81 of the enclosure 80. Since the thickness of the upper permanent magnet 33 is determined to be larger than the maximum displacement of the diaphragm 11, when the diaphragm 11 is vibrated up and down by the voice coil 20, the diaphragm 11 and the surround 60 are not in contact with the upper wall 81 of the enclosure 80. Further, a side wall of the enclosure 80 is provided with an upper opening 83 in fluid communication with the upper space 91 of the diaphragm 11.

The lower side of the diaphragm 11 of the slim acoustic transducer 10 is covered by the lower wall 82 of the enclosure 80 so that an lower space 92 of the diaphragm 11 is formed between the bottom surface of the diaphragm 11 surrounded by the lower permanent magnet 35 and the lower wall 82 of the enclosure 80. Since the thickness of the lower permanent magnet 35 is determined to be larger than the maximum displacement of the diaphragm 11, when the diaphragm 11 is vibrated up and down by the voice coil 20, the diaphragm 11 and the suspension 70 are not in contact with the lower wall 82 of the enclosure 80. Further, the other side wall of the enclosure 80 is provided with a lower opening 84 in fluid communication with the lower space 92 of the diaphragm 11. The lower opening 84 is in fluid communication with an inner space 87 of the enclosure 80 provided at one side of the slim acoustic transducer 10. The inner space 87 of the enclosure 80 may be formed as a closed space formed by the upper wall 81, the lower wall 82, and the side wall 86 of the enclosure 80.

Also, the upper space 91 and the lower space 92 of the diaphragm 11 are separated from each other by a middle wall 85. Accordingly, the upper space 91 of the diaphragm 11 is not in fluid communication with the inner space 87 of the enclosure 80.

Accordingly, when a voice signal corresponding to the sound to be reproduced is input to the voice coil 20 through the suspension 70, the voice coil 20 is vibrated by the magnetic field applied by the upper permanent magnet 33 and the lower permanent magnet 35. Thus, the diaphragm 11 provided integrally with the voice coil 20 vibrates to generate sound. When the diaphragm 11 vibrates to generate sound, the volume of each of the upper space 91 and the lower space 92 of the diaphragm 11 changes so that a flow of air may be generated.

For example, as illustrated in FIG. 8, when the diaphragm 11 moves upward, the volume of the upper space 91 of the diaphragm 11 is reduced, so that the air in the upper space 91 is discharged to the outside of the upper permanent magnet 33 through the plurality of air passages 41 provided in the upper permanent magnet 33. As illustrated in FIG. 8, since only one side surface of the upper permanent magnet 33 is opened and the other side surfaces of the upper permanent magnet 33 are surrounded by the enclosure 80, the air discharged through the plurality of air passages 41 is discharged to the outside of the enclosure 80 through the upper opening 83 (see arrow of FIG. 9).

On the other hand, as illustrated in FIG. 8, when the diaphragm 11 moves upward, the volume of the lower space 92 of the diaphragm 11 becomes larger, so that the air in the inner space 87 of the enclosure 80 flows into the lower space 92 of the diaphragm 11 through the plurality of air passages 42 provided in the lower permanent magnet 35. As illustrated in FIG. 10, since only one side surface of the lower permanent magnet 35 is opened and the other side surfaces of the lower permanent magnet 35 are surrounded by the enclosure 80, the air in the inner space 87 of the enclosure 80 is drawn through the lower opening 84 and moved to the lower space 92 of the diaphragm 11 through the plurality of air passages 42 of the lower permanent magnet 35 (see arrow of FIG. 10).

Although not illustrated, when the diaphragm 11 moves downward, the volume of the upper space 91 of the diaphragm 11 becomes larger, and the volume of the lower space 92 becomes smaller, so that the air moves inversely to the above description.

In the above description, the slim acoustic transducer 10 has the suspension 70 that is formed to perform both the function to support the diaphragm 11 and the function to transmit a voice signal to the voice coil 20. However, the slim acoustic transducer may be formed so that a suspension only performs the function of supporting the diaphragm.

Hereinafter, a slim acoustic transducer according to another example embodiment of the present disclosure will be described with reference to FIGS. 11 to 14.

Figure 11:
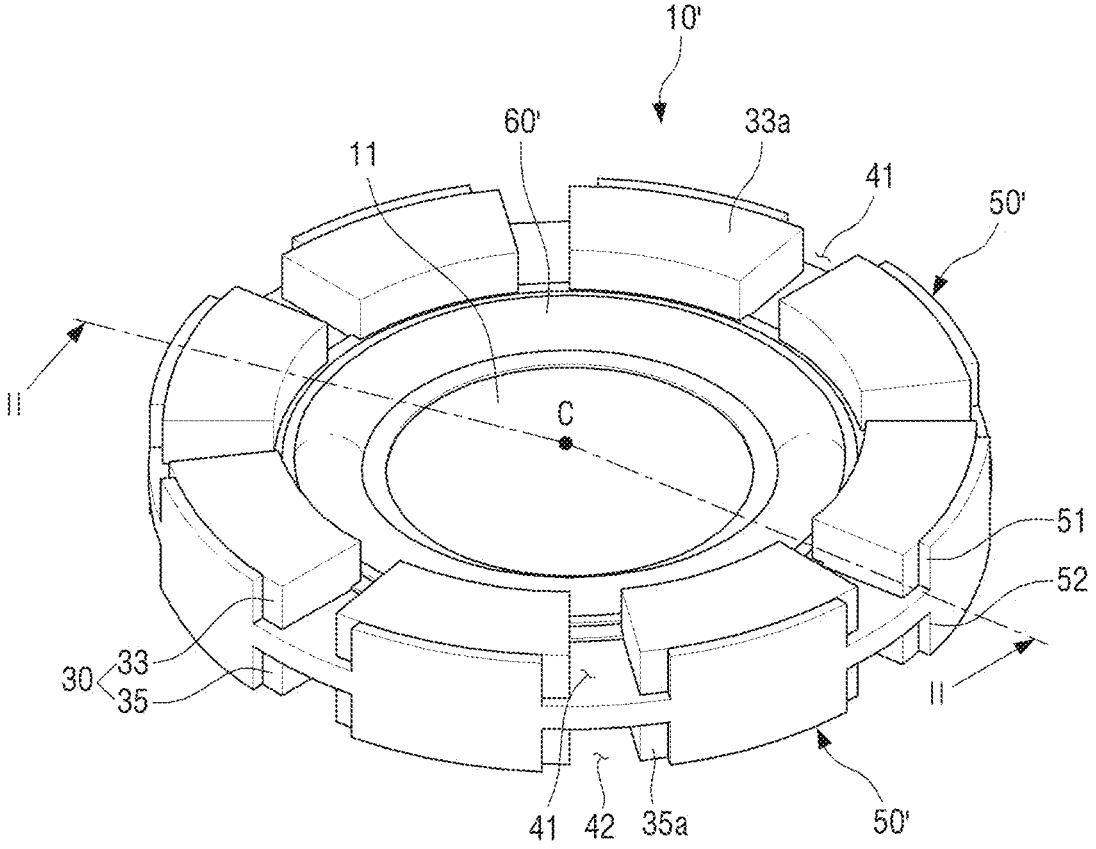
FIG. 11 is a perspective view illustrating an example slim acoustic transducer according to another example embodiment of the present disclosure.
Figure 12:
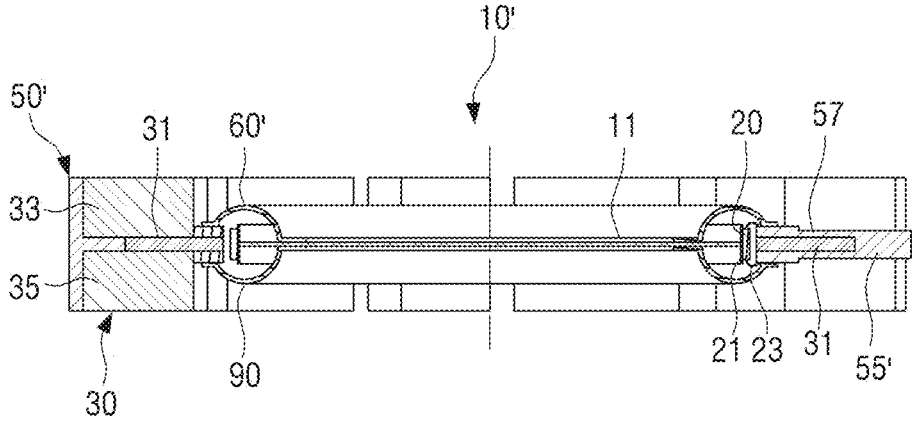
FIG. 12 is a cross-sectional view illustrating the slim acoustic transducer of FIG. 11 taken along a line of II-II.
Figure 13:
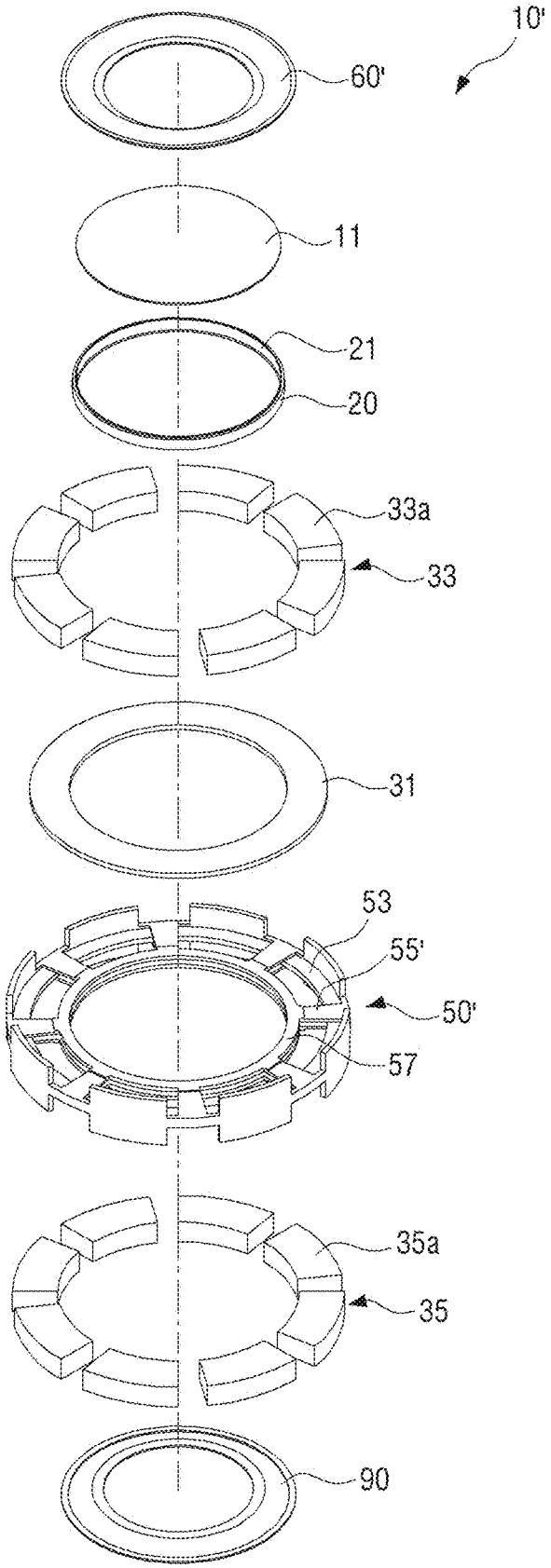
FIG. 13 is an exploded perspective view illustrating the slim acoustic transducer of FIG. 11.
Figure 14:
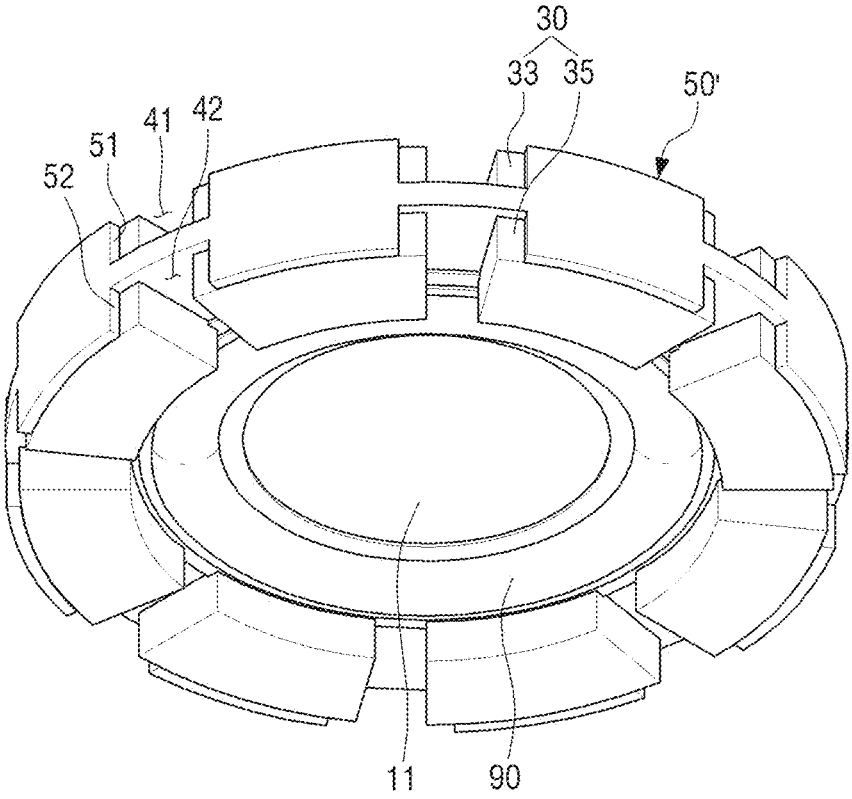
FIG. 14 is a rear perspective view illustrating the slim acoustic transducer of FIG. 11.

FIG. 11 is a perspective view illustrating an example slim acoustic transducer according to another example embodiment of the present disclosure. FIG. 12 is a cross-sectional view illustrating the slim acoustic transducer of FIG. 11 taken along a line of FIG. 13 is an exploded perspective view illustrating the slim acoustic transducer of FIG. 11, and FIG. 14 is a rear perspective view illustrating the slim acoustic transducer of FIG. 11.

Referring to FIGS. 11 to 14, a slim acoustic transducer 10' according to another example embodiment of the present disclosure may include a diaphragm 11, a voice coil 20, a permanent magnet 30, a surround 60', a suspension 90, and a frame 50'.

The diaphragm 11, the voice coil 20, and the permanent magnet 30 of the slim acoustic transducer 10' according to the present embodiment are substantially the same as the diaphragm 11, the voice coil 20, and the permanent magnet 30 of the slim acoustic transducer 10 according to the above-described embodiment, and the surround 60', the suspension 90, and the frame 50' of the slim acoustic transducer 10' according to the present embodiment are different from the surround 60, the suspension 70, and the frame 50 of the slim acoustic transducer 10 according to the above-described embodiment.

Accordingly, hereinafter, detailed descriptions of the diaphragm 11, the voice coil 20, and the permanent magnet 30 are omitted, and the surround 60', the suspension 90, and the frame 50' will be described. Components having the same function will be described with the same reference numerals.

The surround 60' is provided to support the diaphragm 11 with respect to the frame 50' so that the diaphragm 11 can vibrate up and down with respect to the permanent magnet 30, and connects the top surface of the diaphragm 11 with the top surface of the frame 50'. For example, the rim of the top surface of the diaphragm 11 and the inner rim of the top surface of the frame 50' are connected by the surround 60' so that the diaphragm 11 is fixed to the frame 50'. The surround 60' is provided all around the verge of the top surface of the diaphragm 11. The surround 60' may be formed of an elastic material such as rubber so that the diaphragm 11 can vibrate up and down integrally with the voice coil 20. In the present example embodiment, since the frame 50' is formed to cover the top surface and the bottom surface of the intermediate plate 31, the surround 60' is fixed to the top surface of the frame 50'. However, in the case where the intermediate plate 31 is exposed to the inside from the frame 50' as in the above-described example embodiment, the surround 60' may be fixed to the top surface of the intermediate plate 31.

The suspension 90 is provided to support the bottom surface of the diaphragm 11 with respect to the frame 50' so that the diaphragm 11 can vibrate up and down with respect to the permanent magnet 30. The suspension 90 connects the bottom surface of the diaphragm 11 with the bottom surface of the frame 50'. For example, the rim of the bottom surface of the diaphragm 11 and the inner rim of the bottom surface of the frame 50' are connected by the suspension 90 so that the diaphragm 11 is supported by the frame 50'. The suspension 90 is provided all around the rim of the bottom surface of the diaphragm 11. Accordingly, the suspension 90 may be formed in the same or similar shape as the above-described surround 60'. Further, the suspension 90 may be formed of an elastic material such as rubber so that the diaphragm 11 can vibrate up and down integrally with the voice coil 20. In the present example embodiment, since the frame 50' is formed to cover the bottom surface of the intermediate plate 31, the suspension 90 is fixed to the bottom surface of the frame 50'. However, in the case where the intermediate plate 31 is exposed to the inside from the frame 50' as in the above-described example embodiment, the suspension 90 may be fixed to the bottom surface of the intermediate plate 31.

The frame 50' may be formed to fix and support the intermediate plate 31, and the upper permanent magnet 33 and the lower permanent magnet 35 comprising the permanent magnet 30. For example, the frame 50' is formed in a shape corresponding to the upper permanent magnet 33 and the lower permanent magnet 35. In the present example embodiment, since each of the upper permanent magnet 33 and the lower permanent magnet 35 is formed in a substantially circular shape, the frame 50' is also formed in a substantially circular shape. The frame 50' is provided with a plurality of openings 51 and 52 corresponding to the plurality of air passages 41 and 42 of each of the upper permanent magnet 33 and the lower permanent magnet 35. Accordingly, spaces above and below the diaphragm 11 and the outside of the slim acoustic transducer 10' are in fluid communication with each other through the plurality of openings 51 and 52 of the frame 50' and the plurality of air passages 41 and 42 of the permanent magnet 30.

A plurality of seating portions 53 are formed on the inner circumferential surface of the frame 50'. The plurality of seating portions 53 are formed to protrude toward the center from the inner surface of the frame 50'. The plurality of permanent magnet pieces 33*a* constituting the upper permanent magnet 33 are placed on the top surfaces of the plurality of seating portions 53, and the plurality of permanent magnet pieces 35*a* constituting the lower permanent magnet 35 are placed on the bottom surfaces of the plurality of seating portions 53. The thickness of the plurality of seating portions 53 may be formed in the same as the thickness of the intermediate plate 31. A support ring 57 for supporting the intermediate plate 31 is provided in the inside of the plurality of seating portions 53. The above-described surround 60' is disposed on the top surface of the support ring 57 of the frame 50', and the suspension 90 is disposed on the bottom surface of the support ring 57 of the frame 50'. A plurality of fixing protrusions 55' for fixing the support ring 57 with respect to the frame 50' are provided between the plurality of seating portions 53.

In the present example embodiment, since the suspension 90 is not formed of metal, the suspension 90 does not perform the function of transmitting a voice signal to the voice coil 20. Accordingly, wires 23 extending from opposite ends of the voice coil 20 are directly connected to an external electric circuit (not illustrated). For this purpose, the frame 50' may be provided with a groove (not illustrated) through which the wires 23 of the voice coil 20 can pass.

In the slim acoustic transducer 10 and 10' as described above, the upper permanent magnet 33 and the lower permanent magnet 35 may be formed of a plurality of permanent magnet pieces 33*a* and 35*a* to provide the plurality of air passages 41 and 42. However, the structure of each of the upper permanent magnet 33 and the lower permanent magnet 35 is not limited thereto. As another example embodiment, each of the upper permanent magnet and the lower permanent magnet may be formed in a single body.

Hereinafter, a slim acoustic transducer having an upper permanent magnet and a lower permanent magnet that is formed in a single body will be described with reference to FIGS. 15 and 16.

Figure 15:
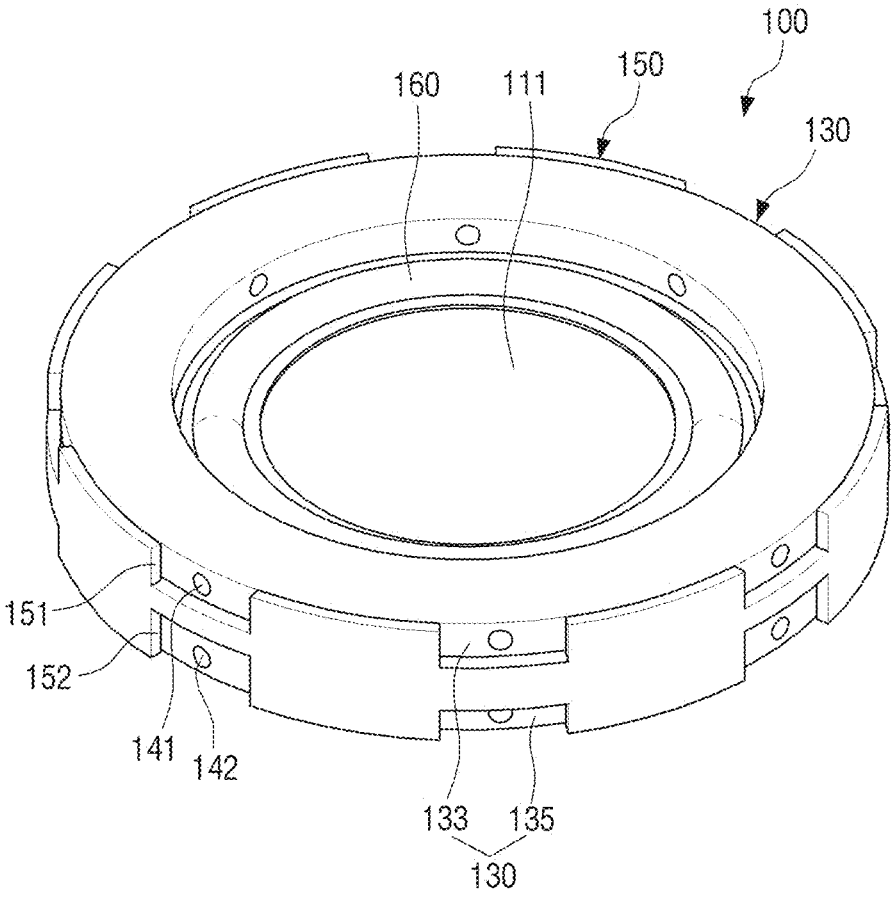
FIG. 15 is a perspective view illustrating an example slim acoustic transducer having air passages according to another example embodiment of the present disclosure.

FIG. 15 is a perspective view illustrating an example slim acoustic transducer having air passages according to another example embodiment of the present disclosure.

Referring to FIG. 15, a slim acoustic transducer 100 according to an example embodiment of the present disclosure may include a diaphragm 11, a voice coil, a surround 160, and a suspension that are substantially the same as the diaphragm 11, the voice coil 20, the surround 60, and the suspension 70 of the slim acoustic transducer 10 according to the above-described example embodiment. A permanent magnet 130 and a frame 150 of the slim acoustic transducer 100 are different from the permanent magnet 30 and the frame 50 of the slim acoustic transducer 10 according to the above-described example embodiment.

Accordingly, hereinafter, descriptions of the diaphragm 111, the voice coil, the surround 160, and the suspension are omitted, and both the permanent magnet 130 and the frame 150 will be described.

The permanent magnet 130 may include an upper permanent magnet 133 and a lower permanent magnet 135. Each of the upper permanent magnet 133 and the lower permanent magnet 135 may be formed in a donut shape. The upper permanent magnet 133 is provided with a plurality of through holes 141 in a radial direction. Also, the lower permanent magnet 135 is provided with a plurality of through holes 142 in the radial direction. An upper space and a lower space of the diaphragm 111 are in fluid communication with the outside through the plurality of through holes 141 and 142. Accordingly, the plurality of through holes 141 and 142 may form the plurality of air passages 41 and 42 of the slim acoustic transducer 10 according to the above-described example embodiment.

The frame 150 may be formed to fix the upper permanent magnet 133 and the lower permanent magnet 135 that are formed in a single body, and support an intermediate plate (not illustrated) provided between the upper permanent magnet 133 and the lower permanent magnet 135. The frame 150 is provided with a plurality of openings 151 and 152 corresponding to the plurality of through holes 141 and 142.

Figure 16:
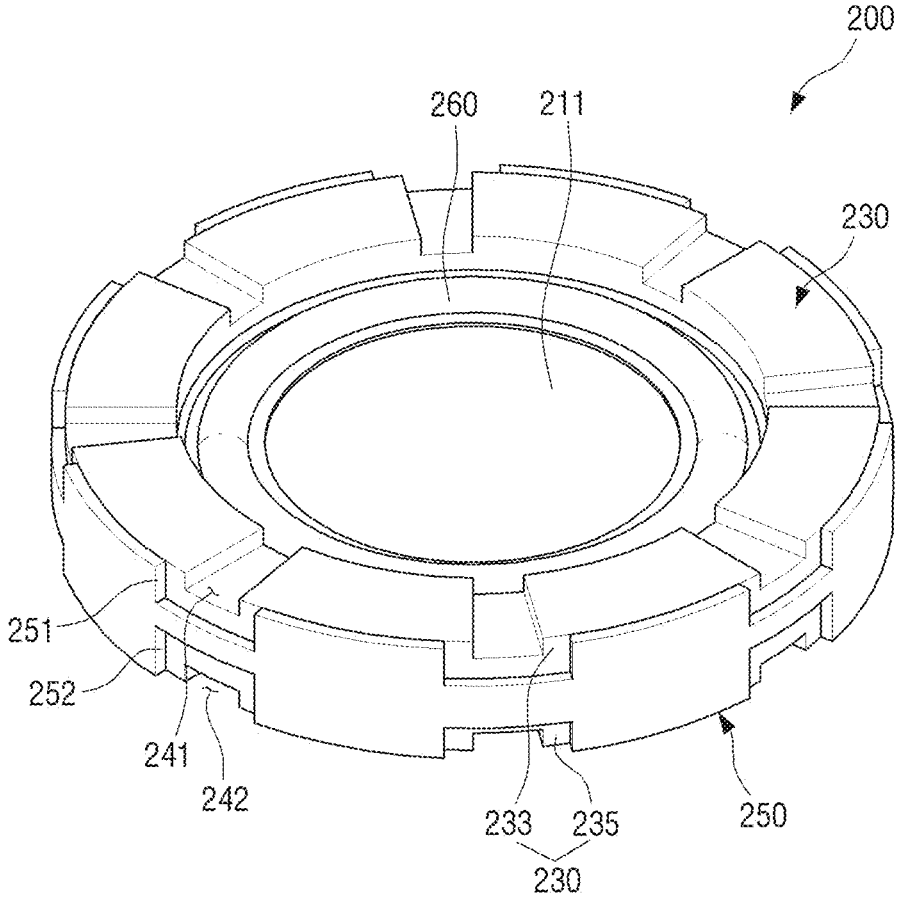
FIG. 16 is a perspective view illustrating an example slim acoustic transducer having air passages according to another example embodiment of the present disclosure.

FIG. 16 is a perspective view illustrating an example slim acoustic transducer having an air passage according to another example embodiment of the present disclosure.

Referring to FIG. 16, a slim acoustic transducer 200 according to an example embodiment of the present disclosure may include a diaphragm 211, a voice coil, a surround 260, and a suspension that are substantially the same as the diaphragm 11, the voice coil 20, the surround 60, and the suspension 70 of the slim acoustic transducer 10 according to the above-described example embodiment. A permanent magnet 230 and a frame 250 of the slim acoustic transducer 200 are different from the permanent magnet 30 and the frame 50 of the slim acoustic transducer 10 according to the above-described embodiment.

Accordingly, hereinafter, descriptions of the diaphragm 211, the voice coil, the surround 260, and the suspension are omitted, and both the permanent magnet 230 and the frame 250 will be described.

The permanent magnet 230 may include an upper permanent magnet 233 and a lower permanent magnet 235. Each of the upper permanent magnet 233 and the lower permanent magnet 235 is formed in a donut shape. The top surface of the upper permanent magnet 233 is provided with a plurality of elongate grooves 241 in a radial direction. Also, the bottom surface of the lower permanent magnet 235 is provided with a plurality of elongate grooves 242 in the radial direction. An upper space and a lower space of the diaphragm 211 are in fluid communication with the outside through the plurality of elongate grooves 241 and 242. Accordingly, the plurality of elongate grooves 241 and 242 may form the plurality of air passages 41 and 42 of the slim acoustic transducer 10 according to the above-described example embodiment.

The frame 250 may be formed to fix the upper permanent magnet 233 and the lower permanent magnet 235 that are formed in a single body, and support an intermediate plate (not illustrated) provided between the upper permanent magnet 233 and the lower permanent magnet 235. The frame 250 is provided with a plurality of openings 251 and 252 corresponding to the plurality of elongate grooves 241 and 242.

As described above, in the slim acoustic transducer 10, 10', 100, and 200 according to an example embodiment of the present disclosure, the permanent magnet 30, 130, and 230 is not disposed below and overlapping the diaphragm 11, 111, and 211 but is provided around the diaphragm 11, 111, and 211. Accordingly, the slim acoustic transducer 10, 10', 100, and 200 according to an example embodiment of the present disclosure may have a thickness smaller than that of the conventional acoustic transducer 1 in which the permanent magnet 5 and the yoke 7, which is a magnetic body, are provided below the diaphragm 3.

Also, since the slim acoustic transducer 10, 10', 100, and 200 according to an example embodiment of the present disclosure does not have a structure in which the diaphragm 11, 111, and 211 and the permanent magnet 30, 130, and 230 are stacked, the amplitude of the diaphragm may be made larger than that of the conventional acoustic transducer even when the thickness of the slim acoustic transducer is reduced. Accordingly, when the thickness of the slim acoustic transducer according to an example embodiment of the present disclosure is made equal to the thickness of the acoustic transducer according to the prior art, there is an advantage that bass performance can be improved as compared with the acoustic transducer according to the prior art.

Accordingly, by using the slim acoustic transducer 10, 10', 100, and 200 according to an example embodiment of the present disclosure, an ultrathin woofer capable of low-frequency reproduction may be implemented.

In the above description, the permanent magnet is comprised of the upper permanent magnet and the lower permanent magnet; however, the structure of the permanent magnet is not limited thereto. The permanent magnet may be formed of one magnet.

Hereinafter, a slim acoustic transducer having a permanent magnet formed of one magnet will be described with reference to FIG. 17.

Figure 17:
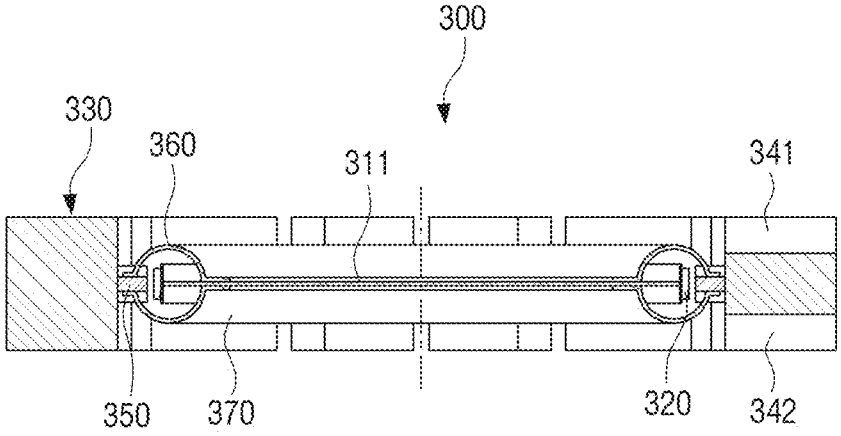
FIG. 17 is a cross-sectional view illustrating an example slim acoustic transducer according to another example embodiment of the present disclosure.

FIG. 17 is a cross-sectional view illustrating an example slim acoustic transducer according to another example embodiment of the present disclosure.

Referring to FIG. 17, a slim acoustic transducer 300 according to an example embodiment of the present disclosure may include a diaphragm 311, a voice coil 320, a surround 360, and a suspension 370 that are substantially the same as or similar to the diaphragm 11, the voice coil 20, the surround 60, and the suspension 70 of the slim acoustic transducer 10 according to the above-described example embodiment. A permanent magnet 330 of the slim acoustic transducer 300 is different from the permanent magnet 30 of the slim acoustic transducer 10 according to the above-described embodiment.

Accordingly, hereinafter, descriptions of the diaphragm 311, the voice coil 320, the surround 360, and the suspension 370 are omitted, and only the permanent magnet 330 will be described.

The permanent magnet 330 is formed in a donut shape. Each of the top surface and the bottom surface of the permanent magnet 330 may be provided with a plurality of air passages 341 and 342. The plurality of air passages 341 and 342 may be formed in a plurality of elongated grooves on the top surface and the bottom surface of the permanent magnet 330.

The surround 360 and the suspension 370 may be fixed to the top surface and the bottom surface of a fixing ring 350 provided in the inner surface of the permanent magnet 330 to support the diaphragm 311.

The slim acoustic transducer 300 according to an example embodiment of the present disclosure having the configuration as described above may reproduce sound by vibrating the diaphragm 311 up and down when a voice signal flows through the voice coil 320.

In the above description of the slim acoustic transducer 10, 10', 100, 200, and 300 according to an example embodiment of the present disclosure, the diaphragm 11, 111, 211, and 311 has a substantially circular shape; however, the shape of the diaphragm 11 is not limited thereto. Although not illustrated, the diaphragm may be formed in a rectangular shape, an elliptical shape, a track shape, or the like. In this case, the permanent magnet may also be formed in a shape corresponding to the diaphragm.

Hereinafter, an image display apparatus having a slim acoustic transducer according to an example embodiment of the present disclosure will be described with reference to FIGS. 18 to 21. A slim television and a mobile device will be described as examples of the image display apparatus. However, the image display apparatus to which the slim acoustic transducer according to an example embodiment of the present disclosure can be applied is not limited thereto.

A slim television in which a slim acoustic transducer according to an example embodiment of the present disclosure is provided will be described with reference to FIGS. 18 and 19.

Figure 18:
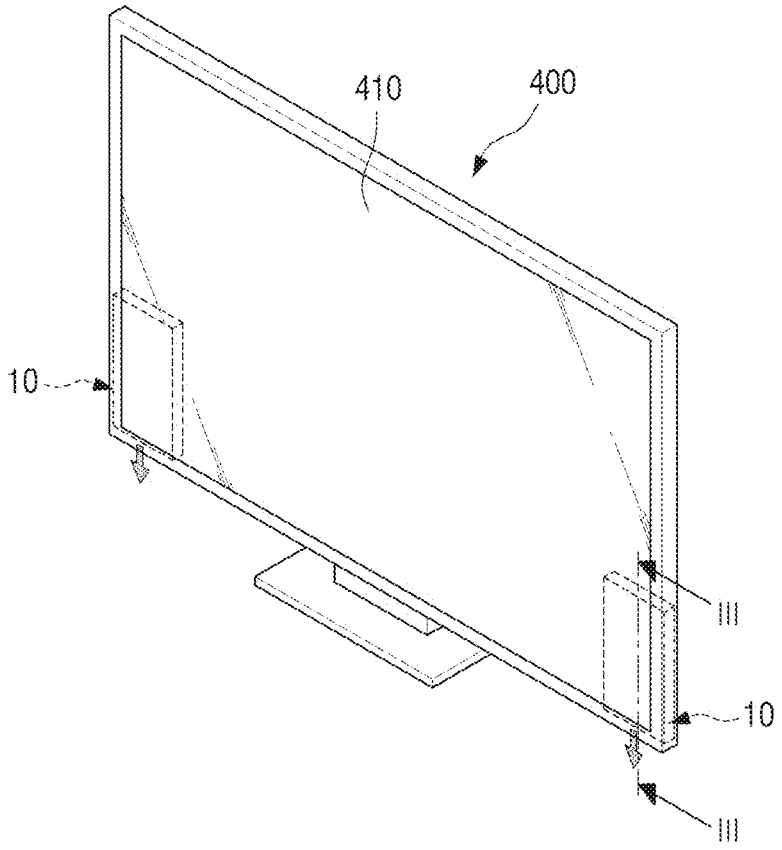
FIG. 18 is a perspective view illustrating an example slim television provided with a slim acoustic transducer according to an example embodiment of the present disclosure.
Figure 19:
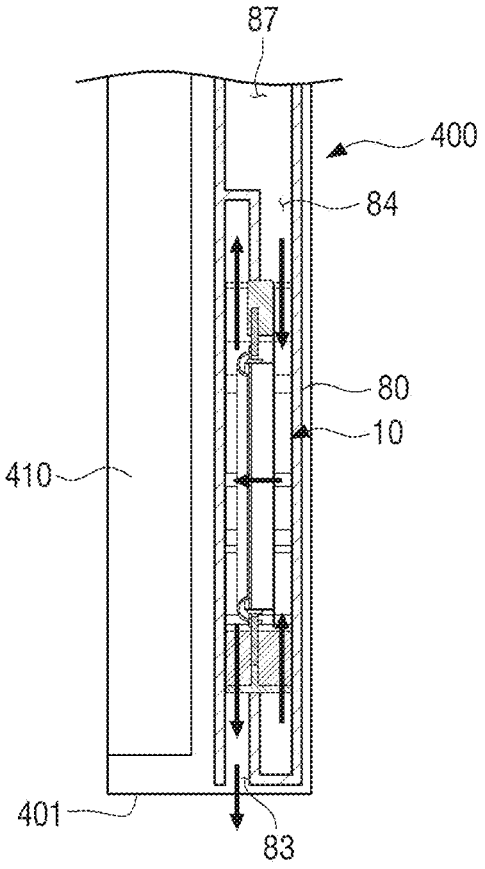
FIG. 19 is a cross-sectional view illustrating the slim acoustic transducer provided in the slim television of FIG. 18 taken along a line of III-III.

FIG. 18 is a perspective view illustrating a slim television provided with a slim acoustic transducer according to an example embodiment of the present disclosure, and FIG. 19 is a cross-sectional view illustrating the slim acoustic transducer provided in the slim television of FIG. 18 taken along a line of III-III.

Referring to FIG. 18, two slim acoustic transducers 10 according to an example embodiment of the present disclosure are provided on the left and right sides of a slim television 400. In this example two slim acoustic transducers 10 are provided to emit sound toward the bottom. However, the disclosure is not limited thereto For example, referring to FIG. 19, the slim acoustic transducer 10 is disposed behind a flat display panel 410, and is provided inside an enclosure 80. A first opening 83 of the enclosure 80, which is in fluid communication with the outside, is provided on the lower surface 401 of the slim television 400, so that sound reproduced by the slim acoustic transducer 10 is output to the outside of the slim television 400 through the first opening 83. Also, a second opening 84 of the enclosure 80 is provided to be in fluid communication with the inner space 87 of the enclosure 80 opposite to the first opening 83.

Accordingly, when the slim television 400 outputs video, the sound is reproduced by the two slim acoustic transducers 10 provided on the lower portions of the left and right sides of the slim television 400.

As described above, since the slim acoustic transducer 10 according to an example embodiment of the present disclosure is very thin, the thickness of the slim television 400 may be reduced even if the flat display panel 410 and the slim acoustic transducer 10 are stacked.

In the slim television 400 as illustrated in FIGS. 18 and 19, the slim acoustic transducer 10 is provided to emit sound toward the bottom; however, a direction in which the slim acoustic transducer 10 emits sound is not limited thereto. For example, the slim acoustic transducer 10 may be provided to emit sound to the left and right of the slim television 400. Alternatively, a waveguide (not illustrated) may be provided so that the slim acoustic transducer 10 emits sound toward the front of the slim television 400.

Hereinafter, a mobile device in which a slim acoustic transducer according to an example embodiment of the present disclosure is provided will be described with reference to FIGS. 20 and 21.

Figure 20:
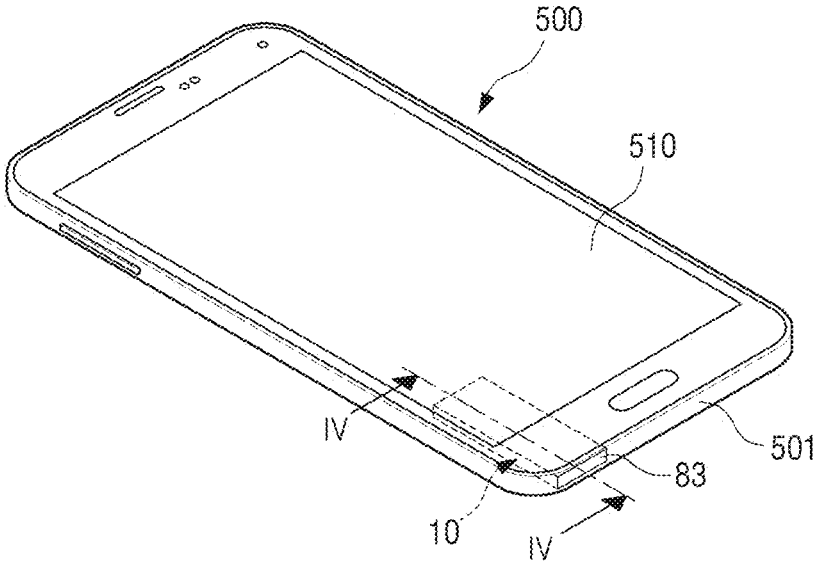
FIG. 20 is a perspective view illustrating an example mobile device provided with an example slim acoustic transducer according to an example embodiment of the present disclosure.
Figure 21:
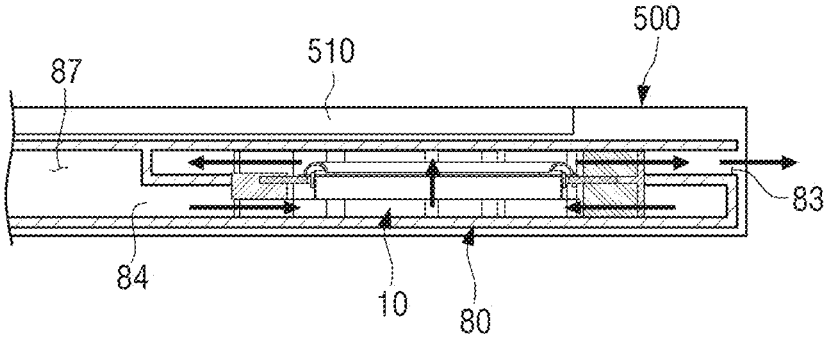
FIG. 21 is a cross-sectional view illustrating the slim acoustic transducer provided in the mobile device of FIG. 20 taken along a line of IV-IV.

FIG. 20 is a perspective view illustrating a mobile device provided with an example slim acoustic transducer according to an example embodiment of the present disclosure, and FIG. 21 is a cross-sectional view illustrating the slim acoustic transducer provided in the mobile device of FIG. 20 taken along a line of IV-IV.

Referring to FIG. 20, a slim acoustic transducer 10 according to an example embodiment of the present disclosure is provided in a side of a lower portion of a smartphone 500. However, it will be understood that the placement of the slim acoustic transducer 10 is not limited thereto.

For example, referring to FIG. 21, the slim acoustic transducer 10 is disposed behind a flat display panel 510, and is provided inside of the enclosure 80. A first opening 83 of the enclosure 80, which is in fluid communication with the outside, is provided on a side surface 501 of the smartphone 500, so that sound reproduced by the slim acoustic transducer 10 is output to the outside of the smartphone 500 through the first opening 83. Also, a second opening 84 of the enclosure 80 is provided to be in fluid communication with the inner space 87 of the enclosure 80 opposite to the first opening 83.

Accordingly, when the smartphone 500 reproduces sound, the sound is reproduced by the slim acoustic transducer 10 provided on the side of the lower portion of the smartphone 500.

As described above, since the slim acoustic transducer 10 according to an example embodiment of the present disclosure is very thin, the thickness of the smartphone 500 may be reduced even if the flat display panel 510 and the slim acoustic transducer 10 are stacked.

In the above description, the smartphone has been illustrated and described as an example of the mobile device; however, the mobile device in which the slim acoustic transducer according to an example embodiment of the present disclosure is used is not limited thereto. The slim acoustic transducer according to an example embodiment of the present disclosure may use in various mobile devices such as a tablet computer, a notebook computer, a portable gaming device, and the like.

In the above description, a slim acoustic transducer according to an example embodiment of the present disclosure is used in an image display apparatus such as a slim television, a mobile device, etc. However, application of the slim acoustic transducer according to an example embodiment of the present disclosure is not limited thereto. The slim acoustic transducer according to an example embodiment of the present disclosure may be implemented as independent speakers or sound bars.

Hereinafter, a slim acoustic transducer according to an example embodiment of the present disclosure implemented as an independent speaker or sound bar will be described with reference to FIGS. 22 to 25.

Figure 22:
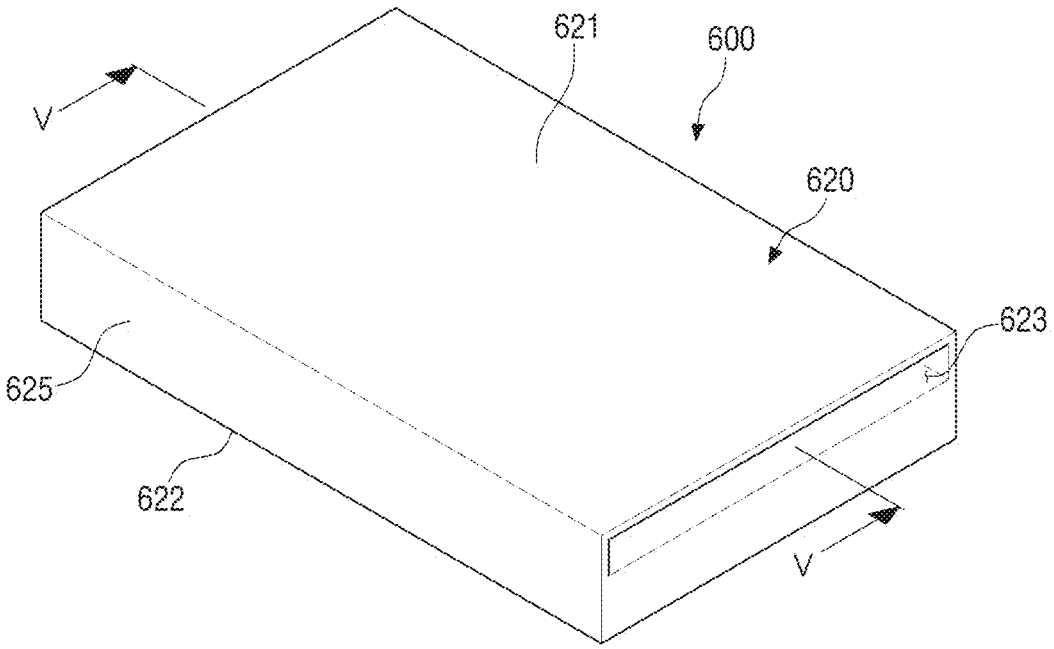
FIG. 22 is a perspective view illustrating an example speaker implemented by a slim acoustic transducer according to an example embodiment of the present disclosure.
Figure 23:
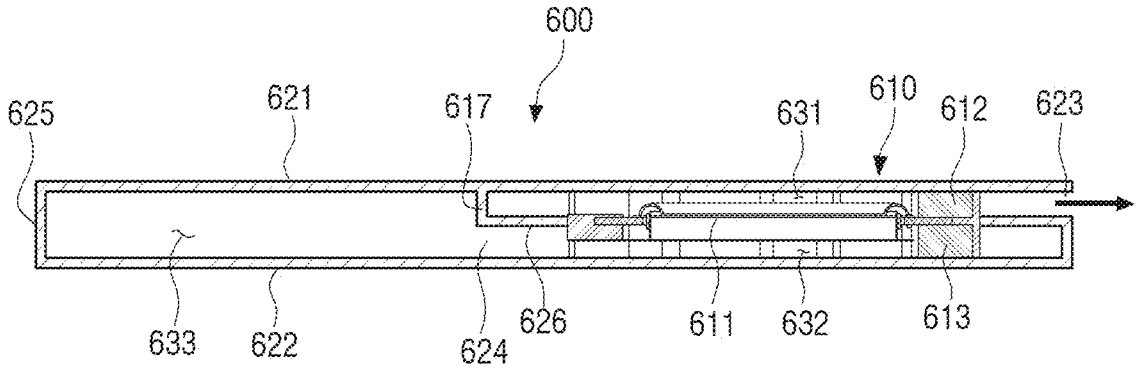
FIG. 23 is a cross-sectional view illustrating the speaker of FIG. 22 taken along a line of V-V.

FIG. 22 is a perspective view illustrating a speaker implemented by an example slim acoustic transducer according to an example embodiment of the present disclosure, and FIG. 23 is a cross-sectional view illustrating the speaker of FIG. 22 taken along a line of V-V.

Referring to FIGS. 22 and 23, in a speaker according to an example embodiment of the present disclosure, a body 620 of the speaker 600 forms an enclosure. In other words, the enclosure 620 forms an outer appearance of the speaker 600. A slim acoustic transducer 610 is provided inside the enclosure 620.

For example, the top surface and the bottom surface of the slim acoustic transducer 610 according to an example embodiment of the present disclosure are covered by an upper wall 621 and a lower wall 622 of the enclosure 620, respectively. Accordingly, the upper side of a diaphragm 611 of the slim acoustic transducer 610 is covered by the upper wall 621 of the enclosure 620 so that an upper space 631 of the diaphragm 611 is formed between the top surface of the diaphragm 611 surrounded by the upper permanent magnet 612 and the upper wall 621 of the enclosure 620. Further, one side wall of the enclosure 620 is provided with a first opening 623 that allows the upper space 631 of the diaphragm 11 to be in fluid communication with the outside. At this time, the upper wall 621 of the enclosure 620 may be provided to be in contact with or spaced apart from the top surface of the upper permanent magnet 612. When the thickness of the speaker 600 is minimized, the upper wall 621 of the enclosure 620 and the top surface of the upper permanent magnet 612 are provided to be in contact with each other.

The lower side of the diaphragm 611 of the slim acoustic transducer 610 is covered by the lower wall 622 of the enclosure 620 so that a lower space 632 of the diaphragm 611 is formed between the bottom surface of the diaphragm 611 surrounded by the lower permanent magnet 613 and the lower wall 622 of the enclosure 620. The lower wall 622 of the enclosure 620 may be provided to be in contact with or spaced apart from the bottom surface of the lower permanent magnet 613. When the thickness of the speaker 600 is minimized, the lower wall 622 of the enclosure 620 and the bottom surface of the lower permanent magnet 613 are provided to be in contact with each other.

The upper space 631 and the lower space 632 of the diaphragm 611 are separated from each other by a middle wall 626 of the enclosure 620. Other configurations of the slim acoustic transducer 610 are the same as those of the slim acoustic transducer 10 according to the above-described embodiment; therefore, detailed descriptions thereof are omitted.

An inner space 633 is provided in a side of the slim acoustic transducer 610. The inner space 633 of the enclosure 620 may be formed as a closed space formed by the upper wall 621, the lower wall 622, and the side wall 625 connecting the upper wall 621 and the lower wall 622. The inner space 633 and the upper space 631 are separated by a partition wall 627 extending from the middle wall 626, and the lower space 632 is in fluid communication with the inner space 633 through the second opening 624. Accordingly, the upper space 631 of the enclosure 620 is not in fluid communication with the inner space 633. The second opening 624 of the enclosure 620 may be provided opposite to the first opening 623.

Accordingly, the sound generated by the vibration of the diaphragm 611 caused due to the voice signal corresponding to the sound to be reproduced is output to the outside of the speaker 600 through the first opening 623 after colliding with the upper wall 621.

Figure 24:
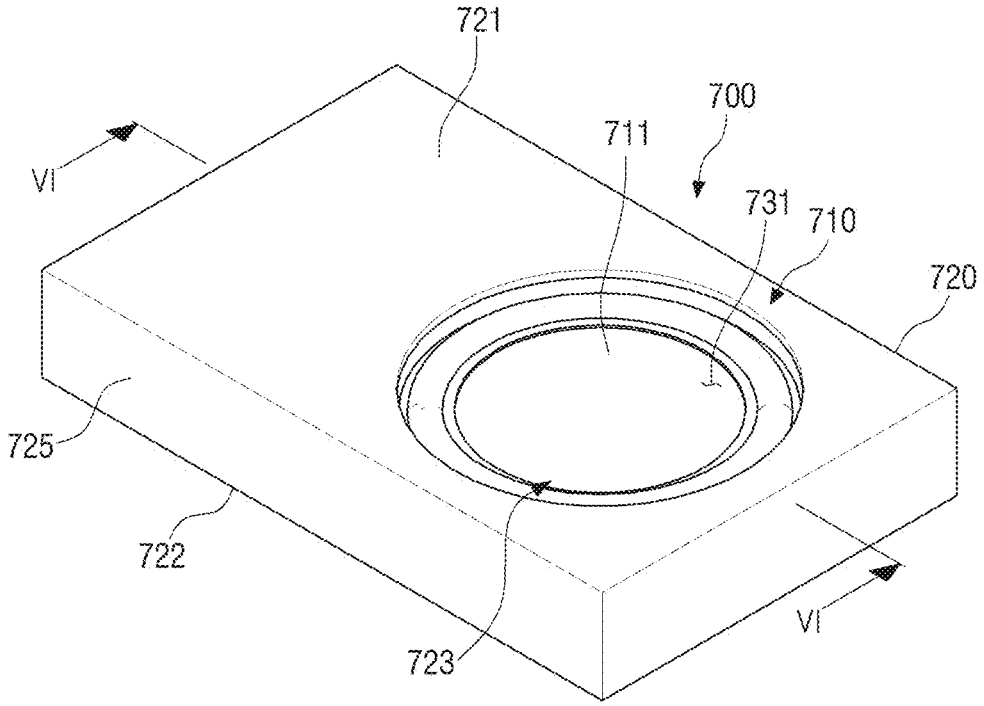
FIG. 24 is a perspective view illustrating an example speaker implemented by a slim acoustic transducer according to another example embodiment of the present disclosure.
Figure 25:
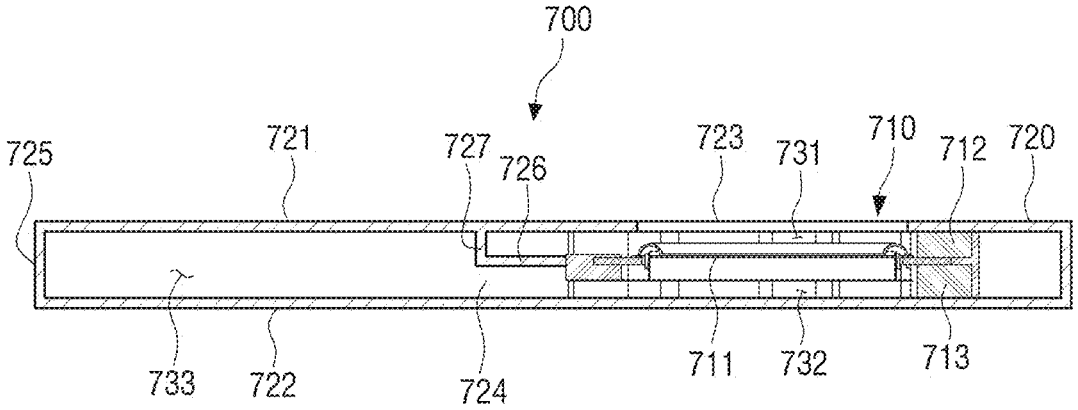
FIG. 25 is a cross-sectional view illustrating the speaker of FIG. 24 taken along a line of VI-VI.

FIG. 24 is a perspective view illustrating a speaker implemented by an example slim acoustic transducer according to another example embodiment of the present disclosure, and FIG. 25 is a cross-sectional view illustrating the speaker of FIG. 24 taken along a line of VI-VI.

Referring to FIGS. 24 and 25, in a speaker 700 according to an example embodiment of the present disclosure, a body 720 of the speaker 700 forms an enclosure. In other words, the enclosure 720 forms an outer appearance of the speaker 700. A slim acoustic transducer 710 according to an example embodiment of the present disclosure is provided inside the enclosure 720. However, the speaker 700 according to the present example embodiment is different in the output direction of sound from the speaker 600 as illustrated in FIGS. 22 and 23.

For example, the top surface and the bottom surface of the slim acoustic transducer 710 according to an example embodiment of the present disclosure are covered by an upper wall 721 and a lower wall 722 of the enclosure 720, respectively. The upper wall 721 is provided with a first opening 723 corresponding to the diaphragm 711. Accordingly, an upper permanent magnet 712 of the slim acoustic transducer 710 is covered by the upper wall 721, and an upper space 731 of the diaphragm 711 surrounded by the upper permanent magnet 712 is exposed to the outside. Since the upper space 731 of the diaphragm 711 is directly in fluid communication with the outside, the upper permanent magnet 712 is not provided with a plurality of air passages unlike the upper permanent magnet 33 of the slim acoustic transducer 10 according to the above-described embodiment.

The lower side of the diaphragm 711 of the slim acoustic transducer 710 is covered by the lower wall 722 of the enclosure 720 so that a lower space 732 of the diaphragm 711 is formed between the bottom surface of the diaphragm 711 surrounded by the lower permanent magnet 713 and the lower wall 722 of the enclosure 720.

The upper space 731 and the lower space 732 of the diaphragm 711 are separated from each other by a middle wall 726 of the enclosure 720. Other configurations of the slim acoustic transducer 710 are the same as those of the slim acoustic transducer 10 according to the above-described embodiment; therefore, detailed descriptions thereof are omitted.

An inner space 733 is provided in a side of the slim acoustic transducer 710. The inner space 733 of the enclosure 720 may be formed as a closed space formed by the upper wall 721, the lower wall 722, and the side wall 725. The inner space 733 and the upper space 731 of the diaphragm 711 are separated by a partition wall 727 extending from the middle wall 726, and the lower space 732 is in fluid communication with the inner space 733 through a second opening 724.

Accordingly, the sound generated by the vibration of the diaphragm 711 caused due to the voice signal corresponding to the sound to be reproduced is output to the outside of the speaker 700 through the first opening 723.

Speakers 600 and 700 or sound bars that are independently formed using a slim acoustic transducer according to an example embodiment of the present disclosure as illustrated in FIGS. 22 to 25 may be fixed to a wall, furniture, or the like using a fixing device (not illustrated).

While various example embodiments of the present disclosure have been described, additional variations and modifications of the embodiments may occur to those skilled in the art. Therefore, it is intended that the appended claims shall be understood to include both the above embodiments and all such variations and modifications that fall within the spirit and scope of the disclosure.

What is claimed is:

1. A slim acoustic transducer comprising:

a diaphragm;

a voice coil disposed at a peripheral portion of the diaphragm so as to surround a periphery of the diaphragm as viewed from above; and a permanent magnet disposed around the voice coil and configured to apply a magnetic field to the voice coil, wherein a maximum amplitude of the diaphragm is less than a thickness of the permanent magnet.

2. The slim acoustic transducer of claim 1, wherein the permanent magnet comprises:

an intermediate plate disposed around the voice coil;

an upper permanent magnet disposed on a top surface of the intermediate plate; and a lower permanent magnet disposed on a bottom surface of the intermediate plate.

3. The slim acoustic transducer of claim 2, wherein the upper permanent magnet and the lower permanent magnet are disposed on the intermediate plate so that like magnetic poles face each other to form a repulsive magnetic field.

4. The slim acoustic transducer of claim 2, wherein each of the upper permanent magnet and the lower permanent magnet includes a plurality of air passages arranged in a radial direction.

5. The slim acoustic transducer of claim 4, wherein the plurality of air passages comprise a plurality of through holes penetrating each of the upper permanent magnet and the lower permanent magnet and arranged in the radial direction.

6. The slim acoustic transducer of claim 4, wherein the plurality of air passages comprise a plurality of elongate grooves arranged in the radial direction in each of a top surface of the upper permanent magnet and a bottom surface of the lower permanent magnet.

7. The slim acoustic transducer of claim 4, wherein each of the upper permanent magnet and the lower permanent magnet comprise a plurality of permanent magnet pieces, and wherein the plurality of air passages are provided between the plurality of permanent magnet pieces.

8. The slim acoustic transducer of claim 7, further comprising:

a frame configured to support and fix the intermediate plate, the upper permanent magnet, and the lower permanent magnet.

9. The slim acoustic transducer of claim 2, further comprising:

a surround connecting a top surface of the diaphragm and a top surface of the intermediate plate; and a suspension structure connecting a bottom surface of the diaphragm and a bottom surface of the intermediate plate.

10. The slim acoustic transducer of claim 9, wherein the suspension structure comprises a conductive material, and the suspension structure is configured to transmit a voice signal to the voice coil.

11. The slim acoustic transducer of claim 2, further comprising:

an enclosure configured to be in contact with a top surface of the upper permanent magnet and a bottom surface of the lower permanent magnet.

12. The slim acoustic transducer of claim 11, wherein the enclosure is configured to cover an upper side of the diaphragm, a side surface of the enclosure includes an upper opening in fluid communication with an upper space of the diaphragm, and another side surface of the enclosure includes a lower opening in fluid communication with a lower space of the diaphragm.

13. The slim acoustic transducer of claim 1, wherein a magnetic body is not provided below and overlapping the diaphragm.

14. A slim acoustic transducer comprising:

a diaphragm;

a voice coil disposed at a peripheral portion of the diaphragm; and a permanent magnet disposed around the voice coil and configured to apply a magnetic field to the voice coil, wherein the permanent magnet comprises an intermediate plate disposed around the voice coil; an upper permanent magnet disposed on a top surface of the intermediate plate; and a lower permanent magnet disposed on a bottom surface of the intermediate plate, and the diaphragm and permanent magnet are configured so that when the diaphragm moves maximally upward the diaphragm does not protrude above a top surface of the upper permanent magnet.

15. The slim acoustic transducer of claim 14, wherein the diaphragm and permanent magnet are configured so that when the diaphragm moves maximally downward, the diaphragm does not protrude below a bottom surface of the lower permanent magnet.

16. The slim acoustic transducer of claim 14, wherein the upper permanent magnet and the lower permanent magnet are disposed on the intermediate plate so that like magnetic poles face each other.

17. The slim acoustic transducer of claim 14, wherein each of the upper permanent magnet and the lower permanent magnet includes a plurality of air passages arranged a radial direction.

18. The slim acoustic transducer of claim 17, wherein the plurality of air passages comprise a plurality of elongate grooves arranged in the radial direction in each of a top surface of the upper permanent magnet and a bottom surface of the lower permanent magnet.

19. The slim acoustic transducer of claim 17, wherein each of the upper permanent magnet and the lower permanent magnet comprise a plurality of permanent magnet pieces, and wherein the plurality of air passages are provided between the plurality of permanent magnet pieces.

20. An image display apparatus, comprising:

a flat display panel configured to output video; and a slim acoustic transducer provided at a side of the flat display panel and configured to output sound, wherein the slim acoustic transducer comprises:

a diaphragm;

a voice coil disposed at a peripheral portion of the diaphragm so as to surround a periphery of the diaphragm as viewed from above; and a permanent magnet disposed around the voice coil and configured to apply a magnetic field to the voice coil, wherein a maximum amplitude of the diaphragm is less than a thickness of the permanent magnet.

* * * * *